US007802381B2

(12) United States Patent
Condie

(10) Patent No.: US 7,802,381 B2
(45) Date of Patent: Sep. 28, 2010

(54) FOOTWEAR FOR USE DURING AND AFTER A PEDICURE AND METHOD OF USING SAME

(75) Inventor: Melissa C Condie, St Louis, MO (US)

(73) Assignee: Eidnoc Enterprises, L.L.C., St. Louis, MO (US)

( * ) Notice: Subject to any disclaimer, the term of this patent is extended or adjusted under 35 U.S.C. 154(b) by 967 days.

(21) Appl. No.: 11/534,123

(22) Filed: Sep. 21, 2006

(65) Prior Publication Data

US 2007/0130802 A1 Jun. 14, 2007

Related U.S. Application Data

(63) Continuation-in-part of application No. 11/363,980, filed on Feb. 28, 2006, now Pat. No. 7,421,807.

(60) Provisional application No. 60/720,261, filed on Sep. 23, 2005.

(51) Int. Cl.
*A43B 3/24* (2006.01)
*A43B 23/08* (2006.01)

(52) U.S. Cl. ..... 36/101; 36/72 R; 36/77 R

(58) Field of Classification Search ..... 36/101, 36/72 R, 77 R, 15, 7.5, 7.6
See application file for complete search history.

(56) References Cited

U.S. PATENT DOCUMENTS

| | | | | |
|---|---|---|---|---|
| 2,506,308 | A | 5/1950 | Maynier | |
| 2,507,120 | A | 5/1950 | Shapiro | |
| D159,662 | S | 8/1950 | Patek | |
| 2,740,207 | A | 4/1956 | Starensier | |
| 2,751,691 | A | 6/1956 | Clark, Jr. | |
| 2,751,693 | A | 6/1956 | Baker | |
| 3,436,843 | A | 4/1969 | Sachs | |
| 3,716,932 | A | 2/1973 | Pakulak | |
| 4,017,987 | A | 4/1977 | Perez, Jr. et al. | |
| 4,177,583 | A | 12/1979 | Chapman | |
| D260,047 | S | 8/1981 | Heinz | |
| D271,156 | S | 11/1983 | Williamson | |
| 4,450,633 | A * | 5/1984 | Connelly | 36/101 |
| D297,380 | S | 8/1988 | Schine | |
| 5,623,734 | A | 4/1997 | Pugliatti | |
| 5,778,565 | A | 7/1998 | Holt et al. | |

(Continued)

FOREIGN PATENT DOCUMENTS

| | | | |
|---|---|---|---|
| DE | 3530511 | A1 | 3/1987 |

*Primary Examiner*—Ted Kavanaugh
(74) *Attorney, Agent, or Firm*—Brian B. Diekhoff; Polsinelli Shughart PC

(57) ABSTRACT

Footwear is described for use during or after a pedicure, and for normal wear when one desires a comfortable shoe with magnets. The footwear includes a main body for receiving a foot and a toe cover that is repeatedly detachable and attachable to the main body or a sole of the footwear. A rear portion of the footwear wraps around a rear of the foot to stabilize the foot. An upper surface of the footwear forms an opening through which the toes are extended. The upper surface also covers a portion of the foot and reduces or inhibits the upward movement of the toes. The toe cover rests on the upper surface. In certain embodiments, the shoe includes two adjustable straps forming the upper over the top of the foot.

28 Claims, 34 Drawing Sheets

U.S. PATENT DOCUMENTS

| | | | |
|---|---|---|---|
| 5,870,837 | A | 2/1999 | Poulos |
| 5,926,978 | A | 7/1999 | Smith |
| 5,946,823 | A | 9/1999 | Yates |
| 6,151,801 | A | 11/2000 | Frederiksen et al. |
| 6,226,893 | B1 | 5/2001 | Schlamp et al. |
| 6,360,457 | B1 | 3/2002 | Qui et al. |
| D468,056 | S | 12/2002 | Goldberg et al. |
| 6,678,971 | B2 | 1/2004 | Brooks |
| 6,874,256 | B2 | 4/2005 | Delgatty |
| 7,134,225 | B2 | 11/2006 | Ashton |
| 2006/0064902 | A1 * | 3/2006 | Ashton ..... 36/72 R |

* cited by examiner 650
630
620
600

650
630
620
672

FOOTWEAR FOR USE DURING AND AFTER A PEDICURE AND METHOD OF USING SAME

This patent application is a continuation-in-part of U.S. patent application Ser. No. 11/363,980 filed Feb. 28, 2006, which claims the benefit of U.S. Provisional Patent Application No. 60/720,261 filed Sep. 23, 2005. This patent application claims the benefit of U.S. Provisional Patent Application No. 60/720,261 filed Sep. 23, 2005. PCT/US06/07199 filed Mar. 1, 2006 claims priority to U.S. patent application Ser. No. 11/363,980 and U.S. Provisional Patent Application No. 60/720,261.

FIELD OF THE INVENTION

The invention relates to footwear for use during and after a pedicure and method of using the footwear. Additionally, the invention relates to footwear for use any time one would like to have a comfortable shoe.

BACKGROUND OF THE INVENTION

The value of looking good can not be underestimated. Careful clothing selection and good personal hygiene can help people not only to feel more confident about themselves, but can actually improve the way that others see and react to them.

Spa treatment for protection of the skin, nails, and hair is becoming more of a necessity than a luxury for many, and the commonality of spa treatments for both women and men is increasing dramatically. Pedicures, in particular, have recently grown in popularity to promote foot health as foot pain from improper care of feet is a well known, and potentially dangerous, concern. The experience of a pedicure also can be very relaxing, and the results are usually having cleaner, more attractive feet and toenails. Often, the main objective of having the pedicure is the cosmetic improvement of the toenails.

For most women (and some men), a pedicure is usually culminated by painting of the toenails. This can provide both personal enjoyment and can improve the appearance of the feet when wearing open toed shoes—which has become as often as possible for many women. Regardless of the aesthetic benefits, painted toenails can provide for both protection of the nails and an enhanced appearance to the feet, as well as complementing or accenting other clothing or personal decoration.

A pedicure, however, is generally not a quick or inexpensive procedure, particularly when professionally performed. Taking time off from other activities to have the procedure implemented, as well as paying a professional for the service, means that the recipient wants the benefits of the procedure to last for as long as possible and the most "professional look" obtainable. To insure that nail polish lasts as long as possible and has the best appearing presentation, it is often required not only that the user spend the time and money to have the pedicure performed professionally, but also to spend a fairly large amount of time after the procedure protecting the nails and the nail polish from any possibility of damage to obtain the best results.

Many pedicure recipients are extra cautious about their feet, and particularly their toenails, for hours after a pedicure to insure that the polish is completely dry before resuming normal activities to prevent any damage or imperfections in the polish. They will often walk very diligently, sometimes with a flatfooted or other uncomfortable gait, and will usually try to keep their distance from any tangible object that could contact their feet. Any contact of the feet to another object is potentially hazardous to the pedicure. If the individual is not extra cautious, any contact can result in polish damage such as, but not limited to, smearing or streaking or other unintended removal of a portion of the polish. Open-toed shoes may also expose the polish to particulate imperfections such as dust, which can become lodged in the polish, spoiling its surface properties. All of these inconveniences often times lead to a feeling of immobilization after one's toenails are painted.

This risk of damaging the pedicure is not eliminated by the wearing of traditional footwear, and, in fact, the wearing of traditional footwear will likely damage the pedicure. While footwear may protect the polish from direct interaction with outside concerns, outside contact with the footwear can cause the foot to shift in the shoe or the shoe to shift relative to the foot, causing interaction between the nails and the interior of the shoe, which can be just as damaging to the polish. This interaction can also be caused by the simple act of walking as the feet and toes will commonly move within footwear to provide for a comfortable stride. These are some of the reasons why people do not wear traditional footwear after a pedicure.

Damage to the toenail polish can come from a large number of sources, many of which a person has no control over. Feet can be impacted by dogs, cats, children, or other people who inadvertently kick, brush, or step on the toes. More commonly, polish can be damaged by walking into or scraping against objects or by walking where particulates are present such as sand, grass, or even carpet. Inclement weather conditions such as snow, rain, puddles, wind blown debris or the like can also present problems.

The number of possible concerns from damage to nail polish arises principally because many nail polishes take a significant amount of time to completely set, even if they are dry to the touch in a matter of minutes. Before it is fully cured, all polish risks damage. Further, even once the polish is dry on the upper surface, polish may still be scuffed, smeared or damaged from a light to heavy impact.

To insure that polish appears the best as possible, people will often plan to be as sedentary as possible after a pedicure in order to avoid damage to the toenails. While simply being sedentary is a fairly effective solution, most people in today's society are too busy to make time for "less movement" to allow nail polish to dry. This means that many people simply forgo the pedicure to save the time and the hassle of having to protect the nails. On those rare occasions when they actually do get a pedicure, many people forget to be as cautious as necessary during the post-pedicure period because they are not in the habit of doing so. This can lead to damage to the nails and frustration that they had the special occasion of the service, paid for a service, and took time out of their schedule to have the service rendered only to have the result damaged. As a result, many people decide to stop receiving pedicures as often as preferred, and in some cases, indefinitely.

SUMMARY OF INVENTION

The present invention relates to footwear for use during and after a pedicure. The footwear includes a main body for receiving a foot and a toe cover that is repeatedly detachable and attachable to the main body or a sole of the footwear. A rear portion of the footwear wraps around a rear of the foot to stabilize the foot. An upper surface forms an opening through which the toes are extended. The upper surface also covers a portion of the foot and reduces or inhibits the upward movement of the toes. The toe cover rests on the upper surface.

The shoe generally stabilizes the foot and prevents the toes of the wearer from contacting the toe cover. The toe cover rests on the upper surface. The shoe bends or flexes without the toes contacting the toe cover. The toe cover contains, covers, and protects the toes of the wearer of the shoe.

The method of wearing footwear of the present invention includes wearing the footwear with the removable toe cover. The method further includes detaching the toe cover, performing a pedicure on the wearer, and attaching the toe cover to rest on the upper surface of the shoe. In certain embodiments, the method includes fastening an adjustable upper. The fastening of the adjustable upper may include fastening the upper as tight or as loose as one deems necessary.

Many of the different shoe embodiments described herein provide for full coverage of the foot, so they protect the foot from the cold weather. This is an important feature, because many people decrease their amount of the pedicures in the colder weather because they do not want to get the chills or feel so cold from wearing a sandal in the winter or during other cold periods of the year.

One embodiment of the footwear includes the rear portion that wraps around the rear of the foot to stabilize the foot. The footwear includes the upper surface forming the opening through which the toes are extended. The upper surface covers a portion of the foot, and the upper surface reduces or inhibits the upward movement of the toes.

Another embodiment of the footwear includes the rear portion that wraps around the rear of the foot to stabilize the foot. Side portions are positioned on both sides of the foot. The side portions are a part of the rear portion. The side portions end before reaching the front of the shoe's sole. This embodiment further includes an adjustable upper surface, which is formed by extending a first strap of the upper's material over the foot and through a slot or a loop of some type on the inner side of the sole of the shoe; and then pulling the first strap back across itself, and attaching the first strap it to itself forming the adjustable upper. The first strap attaches to itself by means of hook and loop fasteners, snaps, or any other means known to one of ordinary skill that allow the first strap of material to attach to itself and form the adjustable upper. Additionally, there is a second strap of material, which is fastened in a similar fashion, however, this material should be fastened further back on the foot—closer to the leg. This second strap is preferably narrower than the first strap of material. The second strap extends from the upper on the outer side of the shoe and goes through a loop which is connected to the upper on the inner side of the shoe. In other embodiments, the first and second straps may extend from the sole. Once this narrower, second strap is fastened to itself, it secures the upper side portions as well as holds the shoe on the foot. After the straps are fastened, the toe area will remain open; and the wider first strap of material will hinder the toes' upward mobility because the first strap will cover the point of inflection of the toes. After the adjustable upper is secured, the toe cover may be attached and it will rest on the adjustable upper surface of the shoe. Along with the functional benefits of protecting the toenail polish and the aesthetic nature of camouflaging the newly painted nails, this embodiment of the shoe for during and after pedicures is especially versatile. Many individuals may choose to wear this embodiment on days when he/she decides not to have a pedicure; and the shoe will of course be very helpful on days when one does have a pedicure. This particular shoe is comfortable and has magnets in the sole, which serve as a method of holding the toe cover on the shoe. The magnets also provide a recessed appearance, which is an appealing feature of the shoe.

Thus, both embodiments of the footwear have an upper surface that covers a portion of the foot, and the upper surface reduces or inhibits the upward movement of the toes in both models. Both embodiments include an attachable and detachable toe cover.

DESCRIPTION OF THE PREFERRED EMBODIMENT(S)

Figure 1:
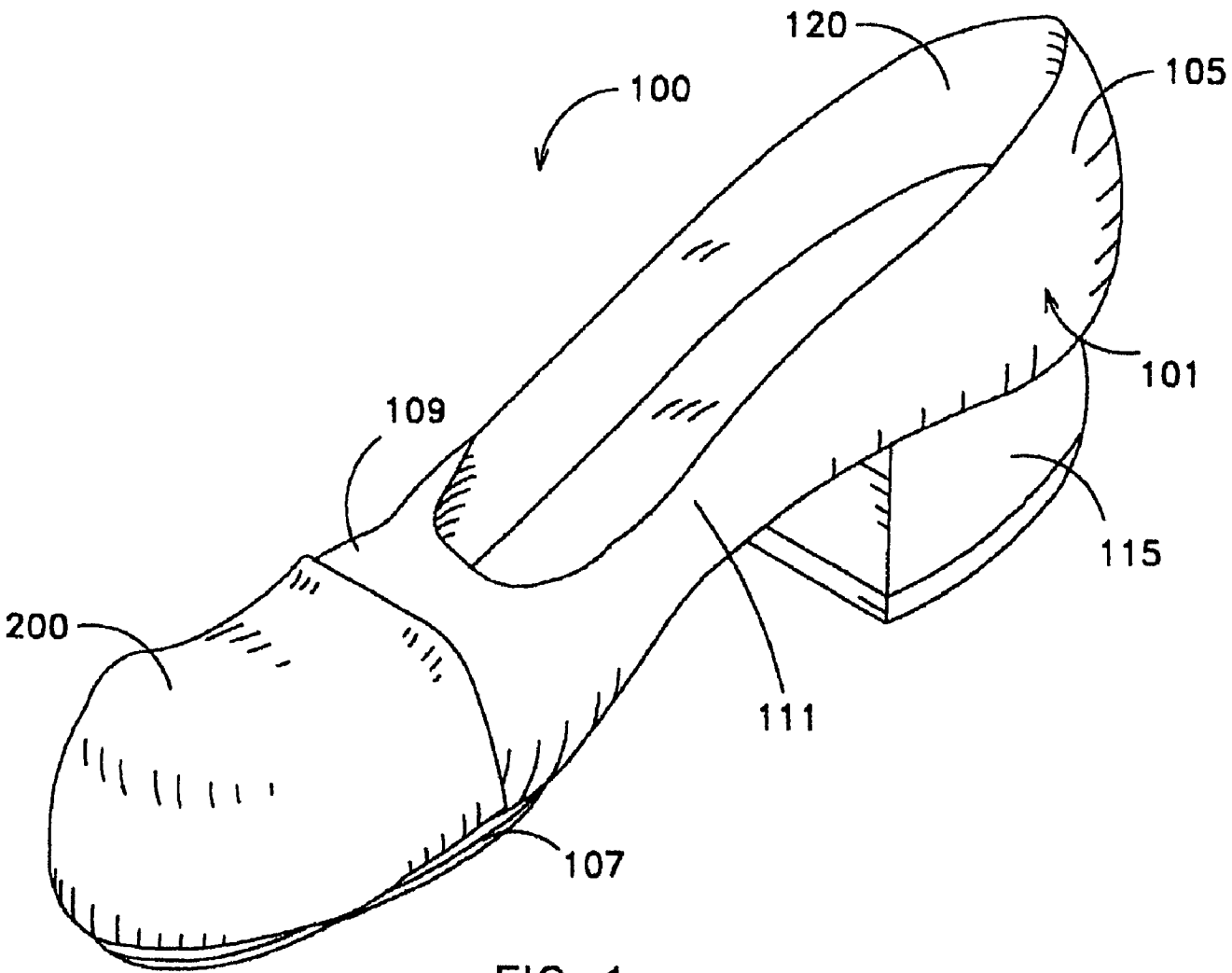
FIG. 1 shows a perspective view of the shoe with the toe cover attached.

Described herein is footwear with extra value added benefits, which is designed specifically to protect toenails from inadvertent contact both from outside sources and from contact with internal structures of the footwear itself for use during and after a pedicure. The footwear is generally in the form of shoes, however, boots, moccasins, slippers or other types of footwear may be constructed according to this invention. The footwear utilizes a two, three or four piece construction, whereby the toes can be exposed from the footwear before the nails are painted, and then can later be contained in the shoe to protect them from movement and potential damage. Certain embodiments include an adjustable upper surface. The adjustable upper surface may comprise one or more straps of material. The added value benefits of the shoe are comfort, water resistance (in certain embodiments), and integral magnets (in certain embodiments).

The shoe 100 generally comprises two main parts, a main body 101 and a removable toe cover 200. The main body 101 of the shoe 100 also generally includes an upper surface 109 which will serve to hold the toes toward a sole 107 and inhibits or reduces the upward movement of the toes. The upper surface 109 limits the usual range of upward mobility for the toes, to reduce its likelihood of contacting the toe cover 200 and damaging the painted nails.

Figure 2A:
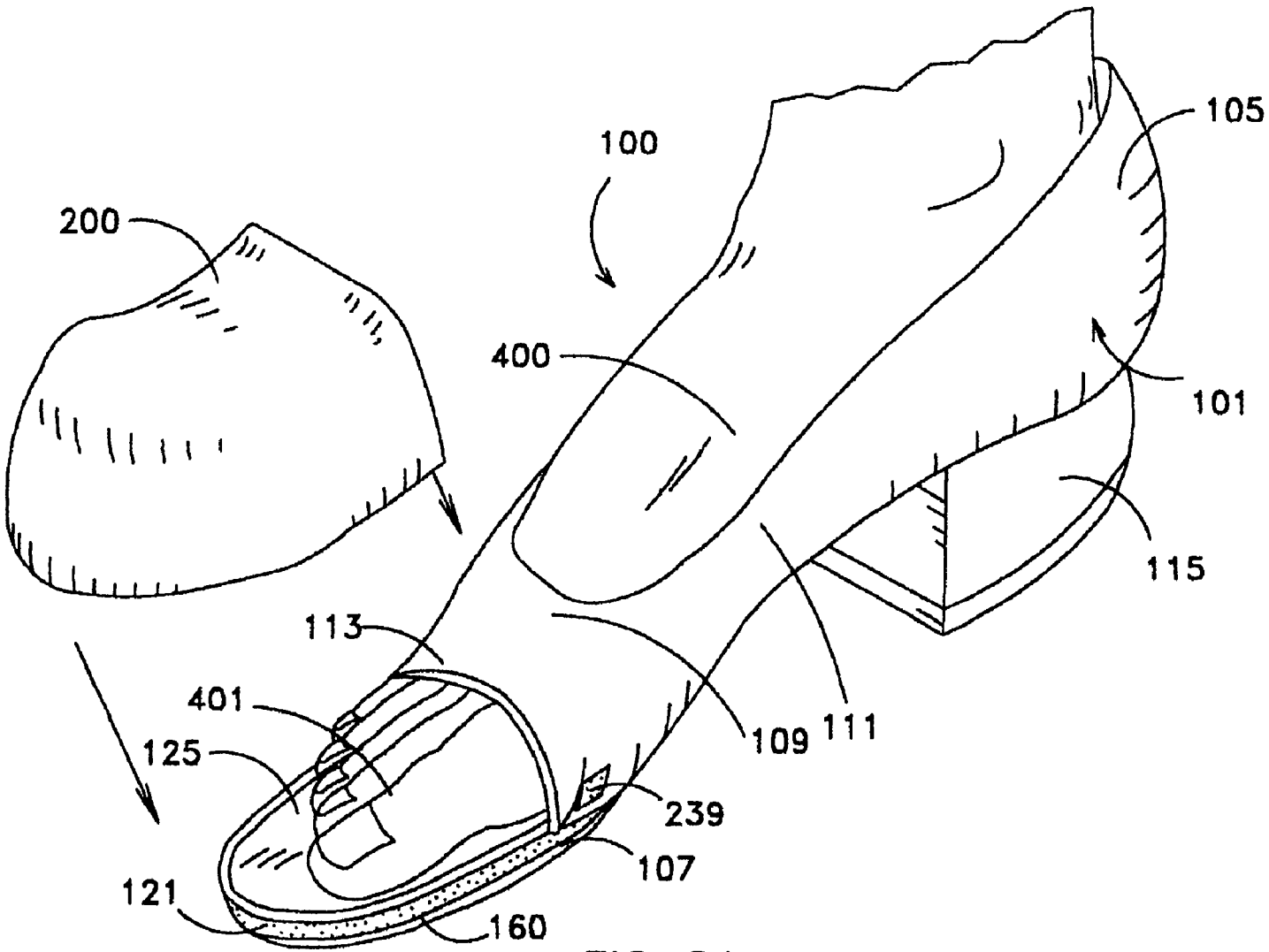
FIG. 2(A) shows a perspective view of the shoe with the toe cover being attached.
Figure 2B:
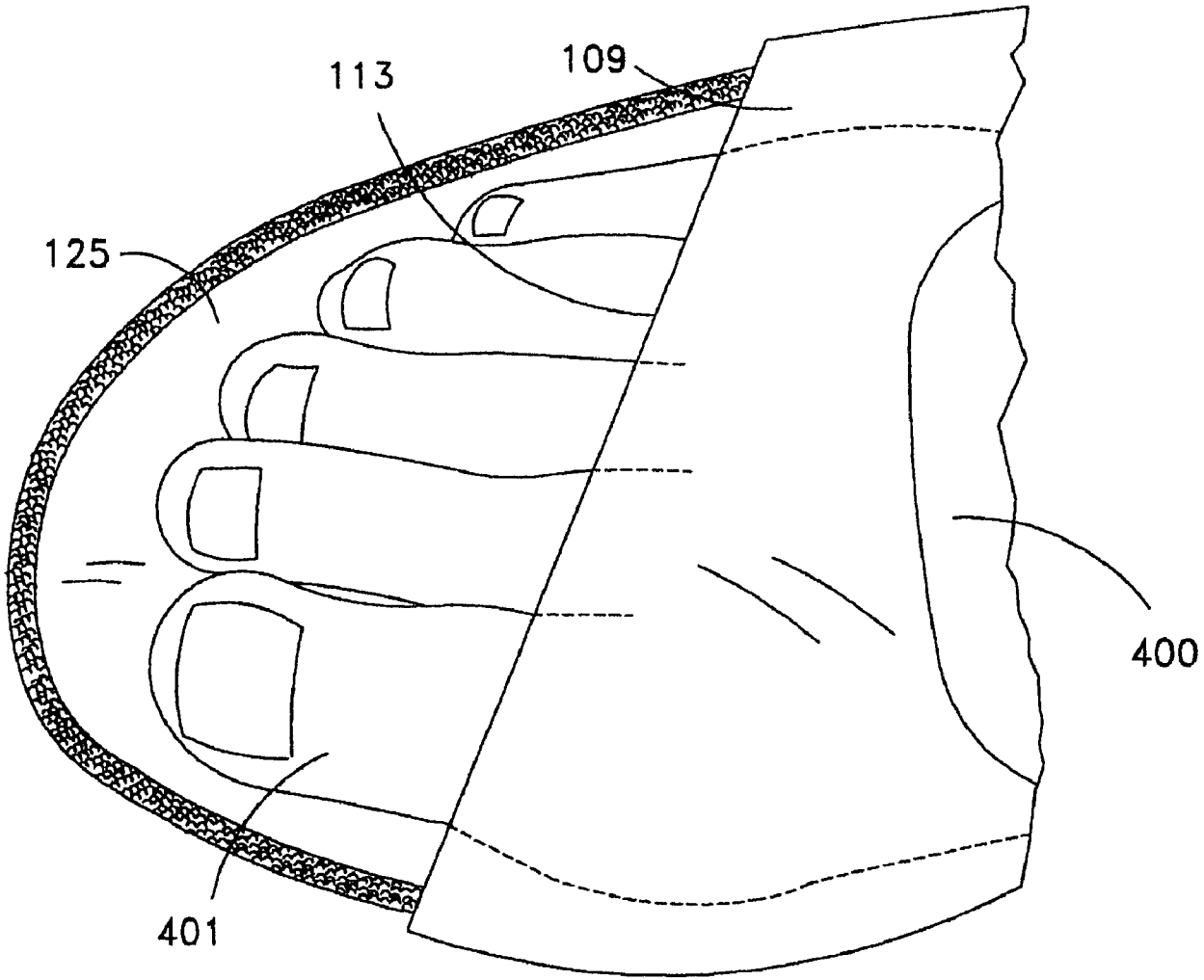
FIG. 2(B) shows a close-up view of the shoe with the toe cover removed revealing the toes.
Figure 3:
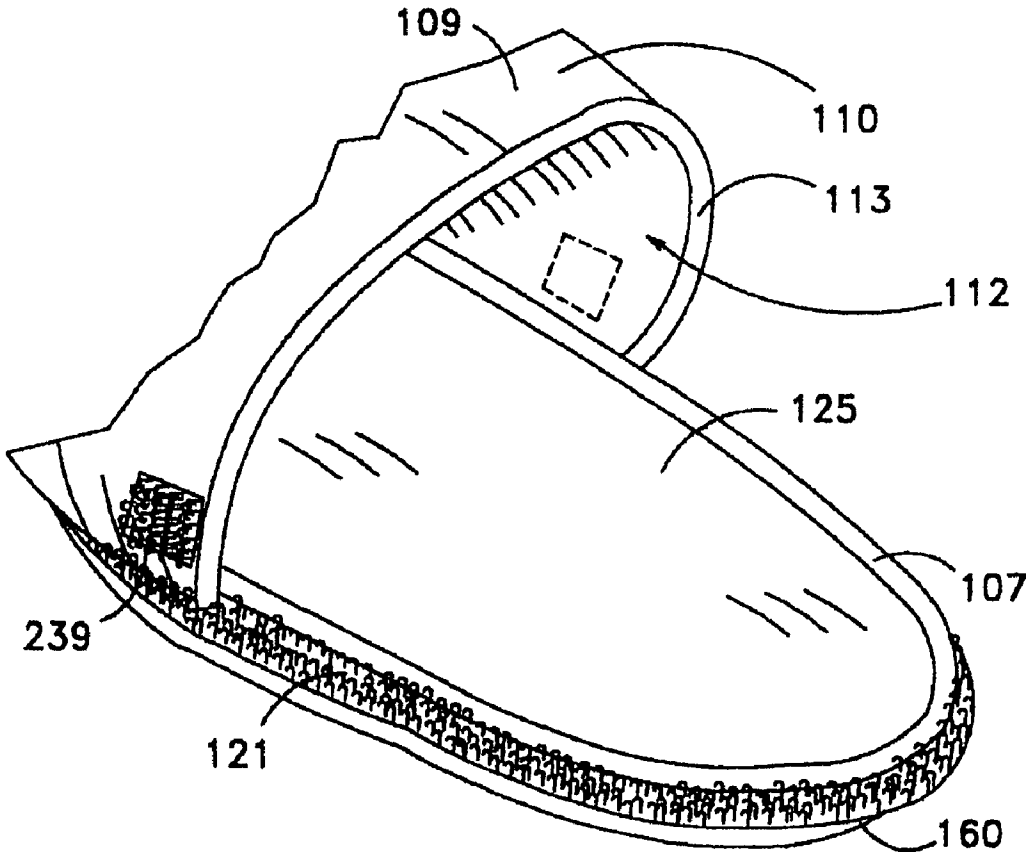
FIG. 3 shows a perspective view of the front of the shoe with the toe cover removed.
Figure 4:
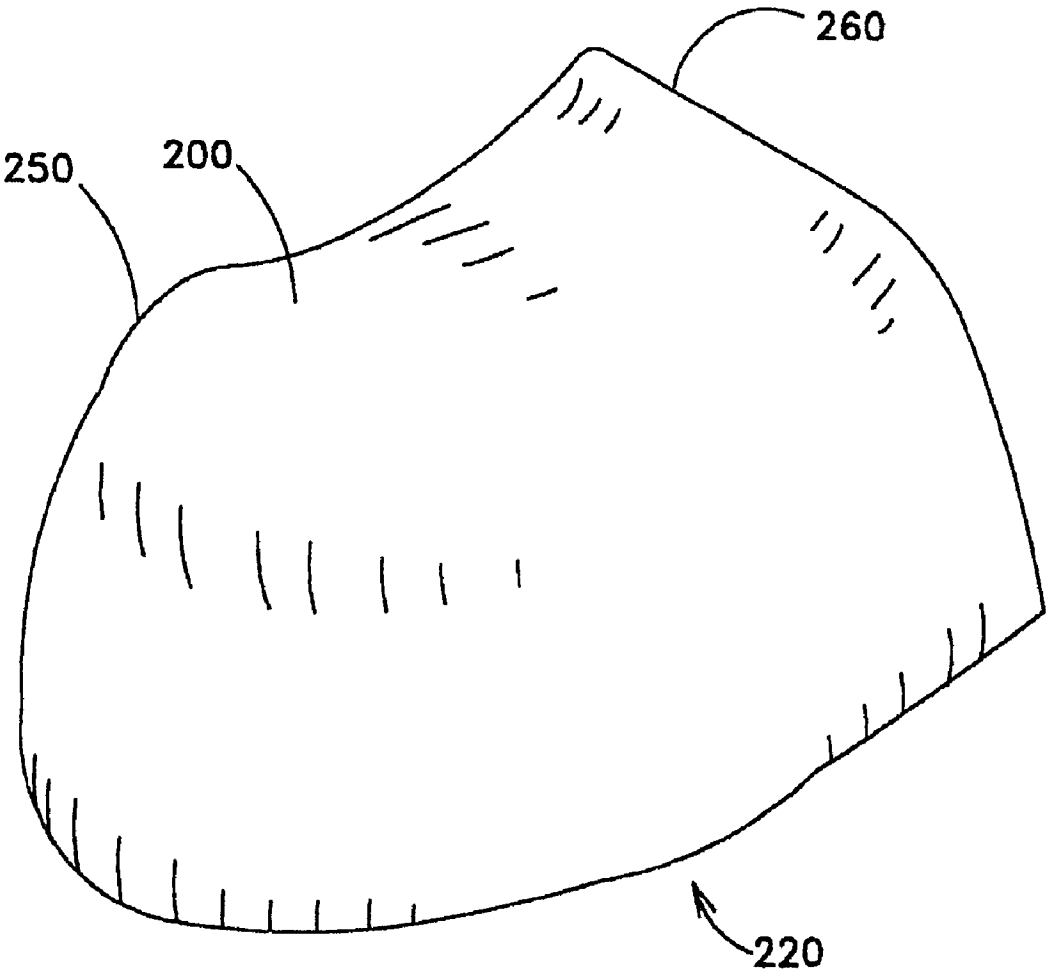
FIG. 4 shows a perspective view of the toe cover.
Figure 5:
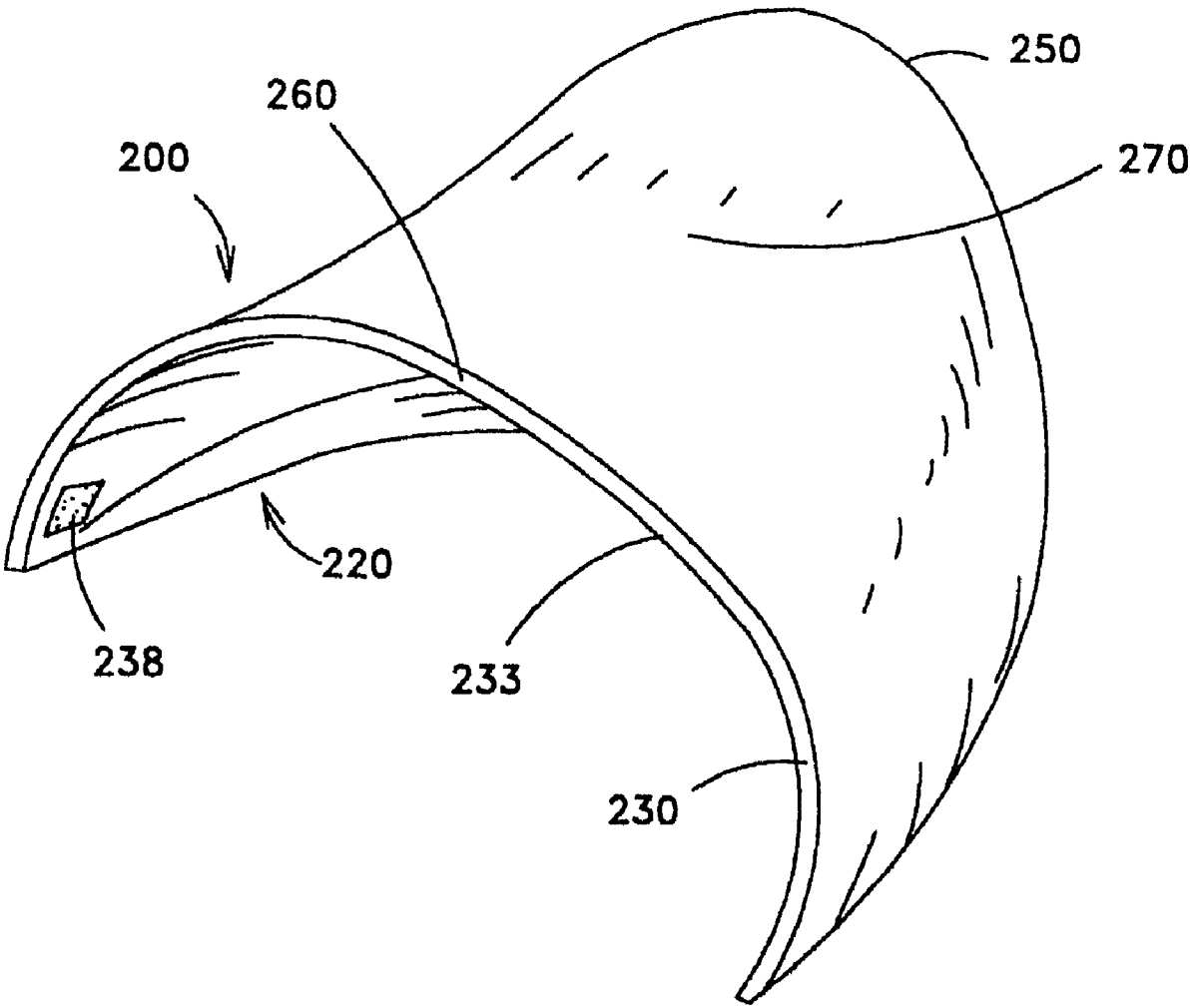
FIG. 5 shows a rear view of the toe cover.
Figure 6:
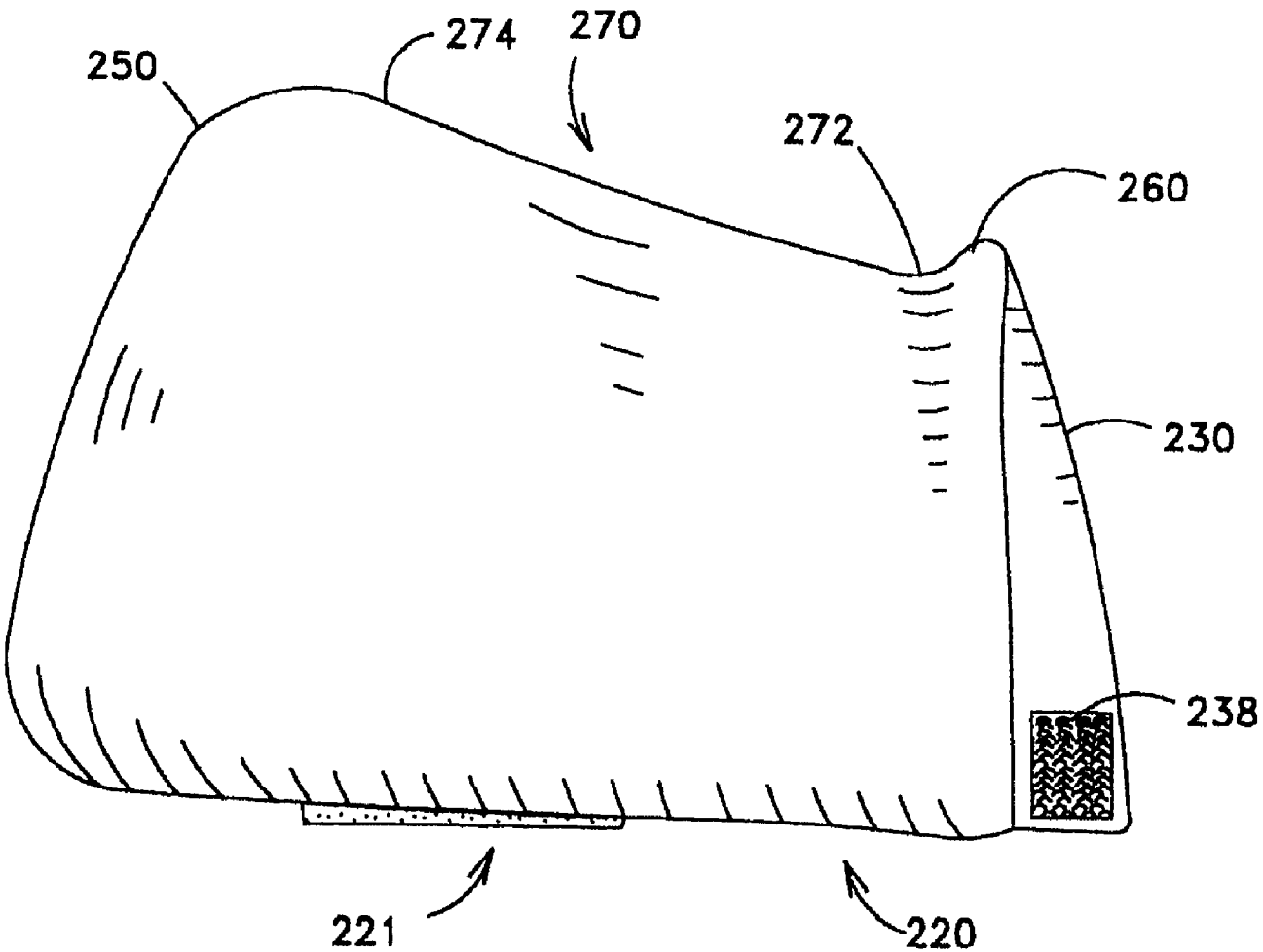
FIG. 6 shows a side view of the toe cover.
Figure 7:
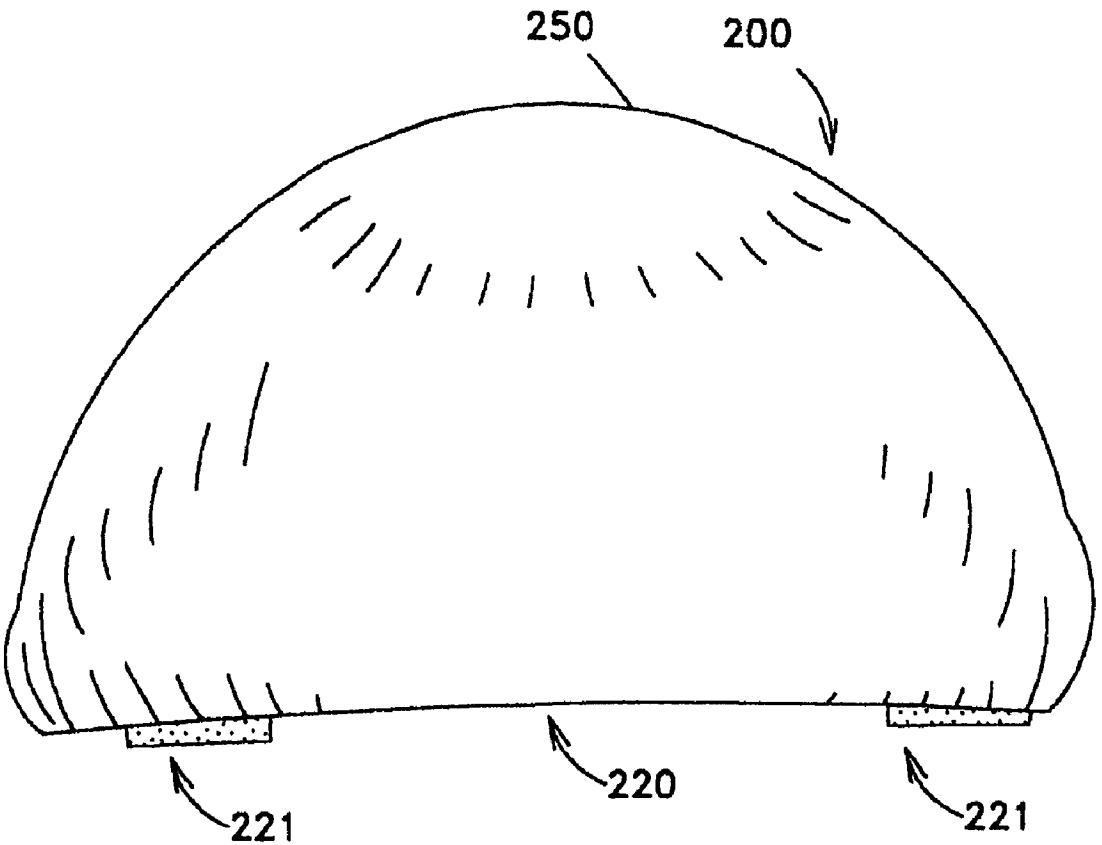
FIG. 7 shows a front view of the toe cover.
Figure 8:
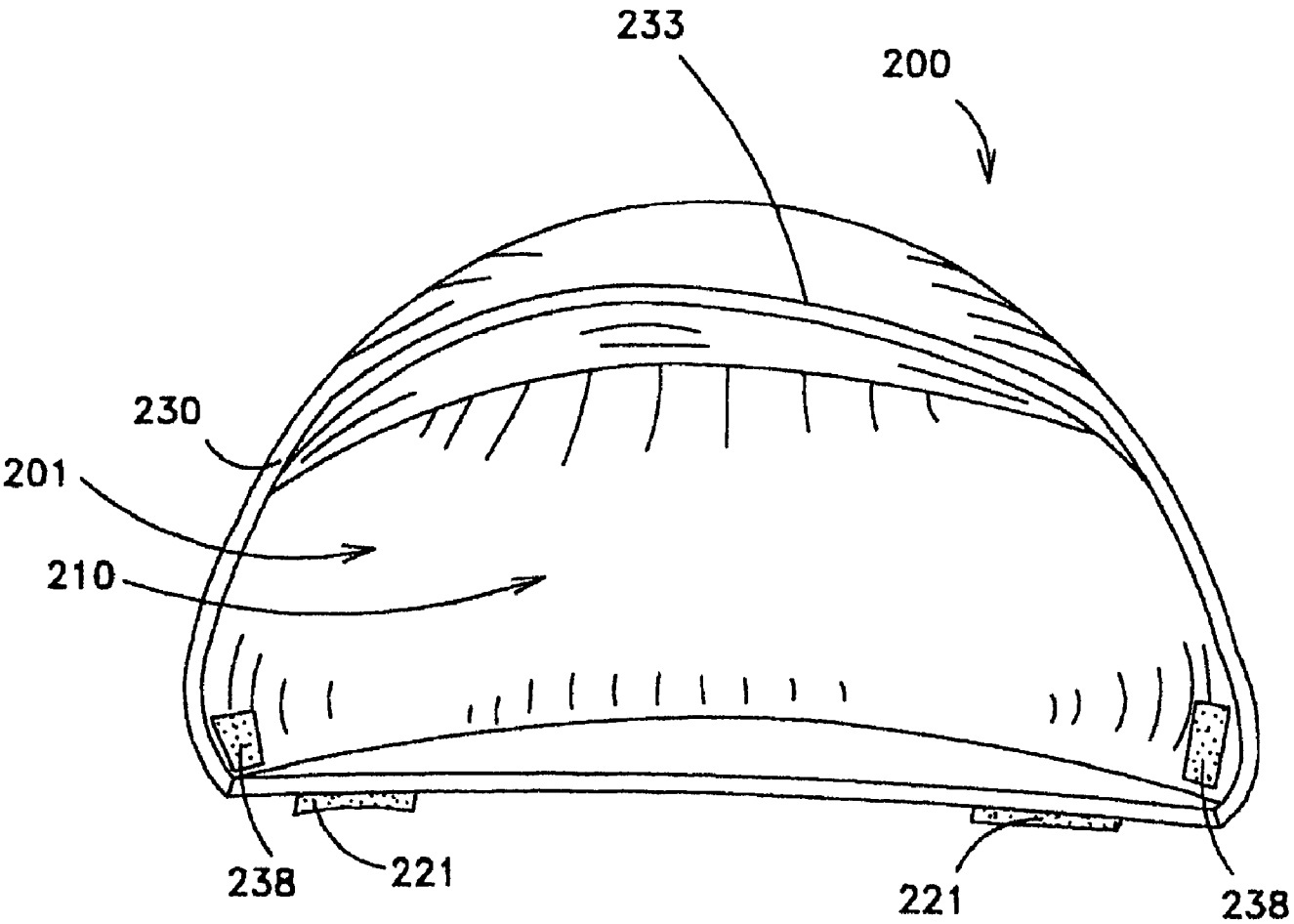
FIG. 8 shows a rear view of the toe cover.
Figure 9:
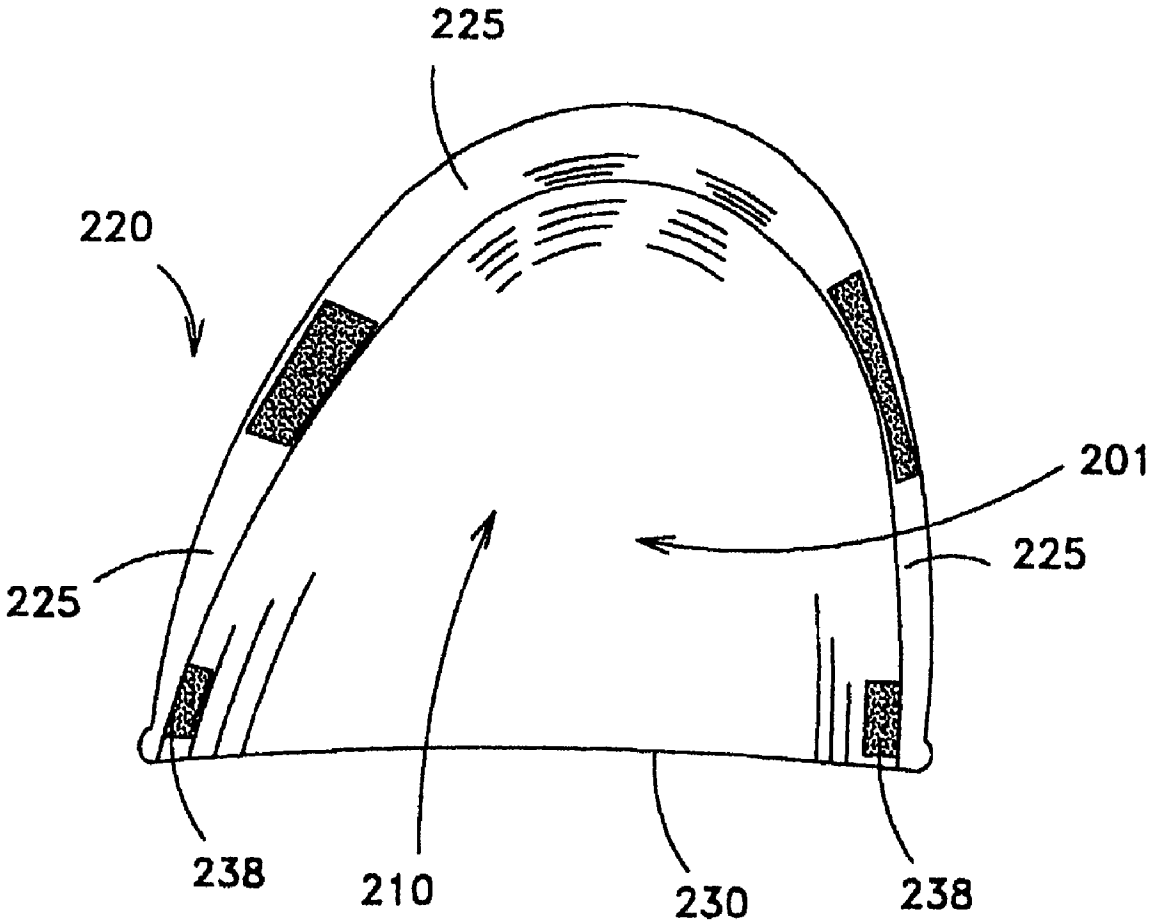
FIG. 9 shows a bottom view of the toe cover.

Certain embodiments of the shoe 100 designed to inhibit toenail polish damage are exemplified in FIGS. 1 through 3. The shoe 100 generally has two parts, the main body 101 which comprises most of the shoe 100 and forms most of its structure and the toe cover 200 which removably attaches to the main body 200 so as to expose or cover the toenails. Generally, the shoe 100, when the main body 101 and toe cover 200 are assembled, resembles a lady's pump, with a marginally higher front section in comparison to similarly shaped shoes. The shoe 100 would be appropriate work attire for many professional women. In other embodiments, the shoe 100 may be constructed to resemble any type of footwear such as a loafer, flat, or something of this type, but the pump type of footwear is preferred because it is generally acceptable for wear with a wide variety of clothing and encases most of the foot to provide for additional protection.

The main body 101 is generally designed to restrict foot movement relative to the structure of the shoe 100. In particular the shoe 100 is designed so that movement of the foot in the shoe 100 is relatively minimal. In this way, if the shoe 100 contacts an outside obstruction due to movement of the foot, the foot will not have the opportunity to bring the toenails into contact with the inner surface of the shoe 100.

So as to provide for foot restraint, the shoe 100 is generally constructed of a wrapping or enclosing design whereby material is placed around the rear and sides of the heel and front of the ankle, generally known as the hindfoot and midfoot so that material of the shoe 100 is placed to block movement of the foot relative to the shoe 100. Generally, the rear 105 of the shoe 100 will wrap or enclose the heel to prevent the heel from sliding backward relative to the sole 107 of the shoe 100. The sides 111 of the shoe 100 will also generally provide for a wrapping or enclosing structure of the heel and midfoot. The sides 111 will generally continue over the midfoot forming the upper surface 109 that limits the range of movement of the toes and keeps the foot from being able to lift from the sole 107 of the shoe 100. This upper surface 109 will generally also be in contact with the front of the ankle, or at least the top of the foot, to inhibit forward motion of the foot relative to the shoe. The sides 111, the rear 105, and the upper surface 109 stabilize the foot in the shoe 100. The sides 111, the rear 105, and the upper surface 109 generally define a foot opening 120 through which the user's foot is inserted. The upper surface 109 forms a toe opening 112 through which the toes are extended.

As is known to one of ordinary skill in the art, such forward inhibition may also be carried out by lacing and the use of a "tongue" resting on the upper surface of the midfoot or by specifically sized and shaped main body 101 designs. Alternatively, the shoe 100 may include lacing or structure that continues up the leg securing the shoe 100 to the calf such as the case with many boots.

The shoe structure of the main body 101 will generally be such that the sides 111 and upper surface 109 terminate in an edge 113 extending just partially over the beginning of the toes. The edge 113 forms an arcuate shape. The edge 113 extends from one side of the shoe 100 to the other side of the shoe 100. The edge 113 angles toward the rear of the shoe 100 on the side of the shoe with the smallest toe. Thus, the toe nails will be fully accessible for the pedicure. The sole 107 will generally continue forward under the toes to the end of the shoe 100 providing support for, and a walking position of, the entire foot.

As should be apparent from FIGS. 1-3, when the main body 101 is placed on the foot without the toe cover 200 in place, the shoe 100 is open in the region of the toes. In particular, at least a portion of the top and sides of the toes and often the end portion of the main foot body is accessible. In this arrangement, the toenails are exposed and accessible which allows them to be painted or pedicured while the main body 101 is on the foot.

The toe cover 200 is repeatedly detachable and attachable to the main body 101 of the shoe 100. When the toe cover 200 is detached, a front region 125 of the shoe 100 upon which the toes rest is exposed. The toe cover 200 may attach or detach using any engaging mechanism known to one of ordinary skill in the art. In the depicted embodiment, strips of hook 121 and loop 221 fasteners (Velcro™) are used as the engaging mechanism between the toe cover 200 and the shoe 100. In other embodiments, the hook 121 and the loop 221 fasteners may be replaced by an alternative repeatedly removable attachment structure such as a removable adhesive, magnets, buttons, zippers, or other structures as known to those of ordinary skill.

The toe cover 200 is shown in detail in FIGS. 4-9. The toe cover 200 defines a cavity 210. The cavity 210 contains, covers, and protects the toes of the wearer of the shoe 100. The toe cover 200 is designed to allow the wearer to flex their toes and angle their toes upward in the cavity 210 as allowed by the upper surface 109, however, the toe cover 200 is designed to accommodate this movement without the toes touching the interior surfaces of the toe cover 200. The toe cover 200 is preferably provided with the shape described herein. A front 250 of the toe cover 200 is higher than a rear 260 of the toe cover 200. A top surface 270 of the toe cover 200 includes a concave surface 272. The concave surface 272 leads into an upwardly sloping surface 274 up to the higher front 250 of the toe cover 200. This combination of the concave surface 272, the upwardly sloping surface 274, and the height of the front 250, provide for the toe cover 200 to accommodate the range of flexion of the toes allowed by the upper surface 109 without the toes touching the toe cover 200. The toe cover 200 also provides an aesthetically pleasing appearance in which the toe cover 200 is shaped to re-establish itself with the contour of the foot by resting on top of the shoe. Thus, the toe cover 200 follows the contour of the shoe 200.

Figure 10:
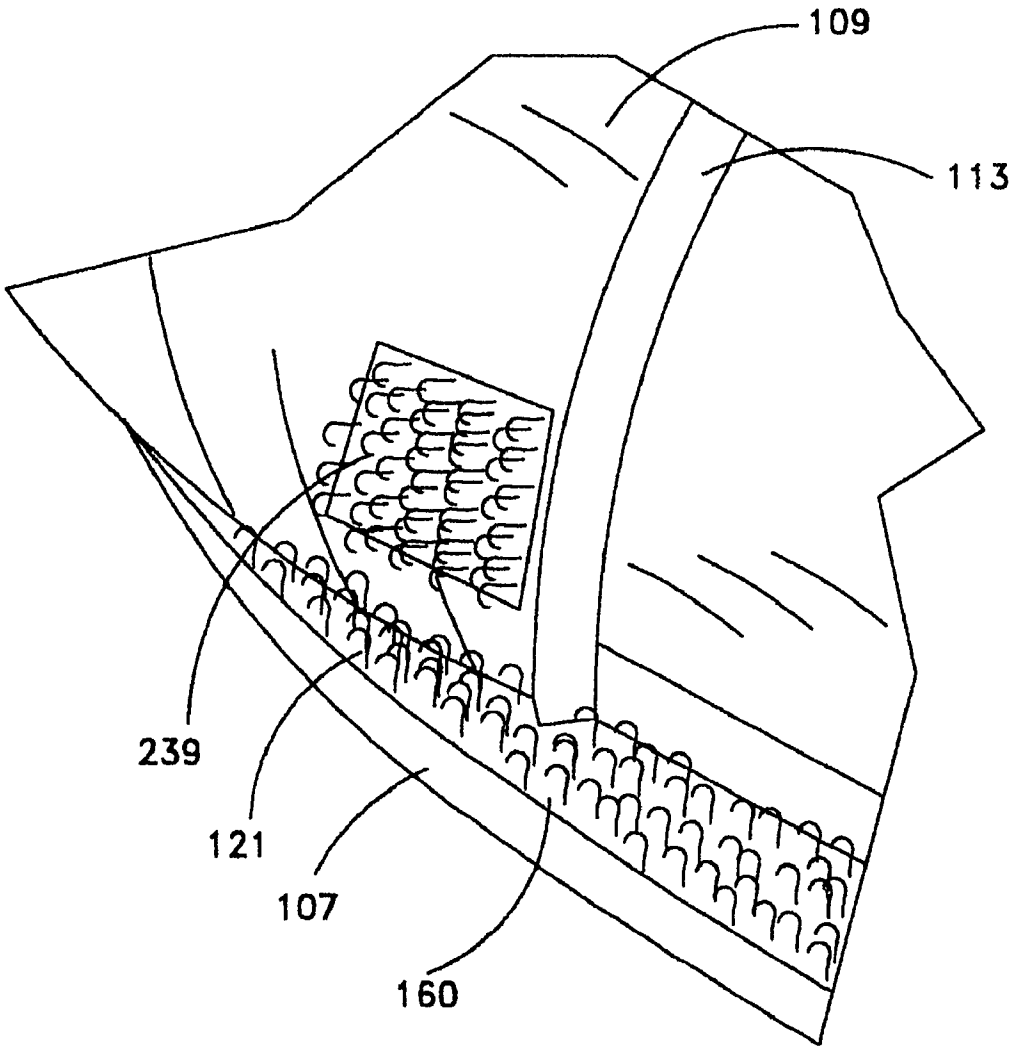
FIG. 10 shows a close-up view of the perimeter of the sole and the upper surface.
Figure 11:
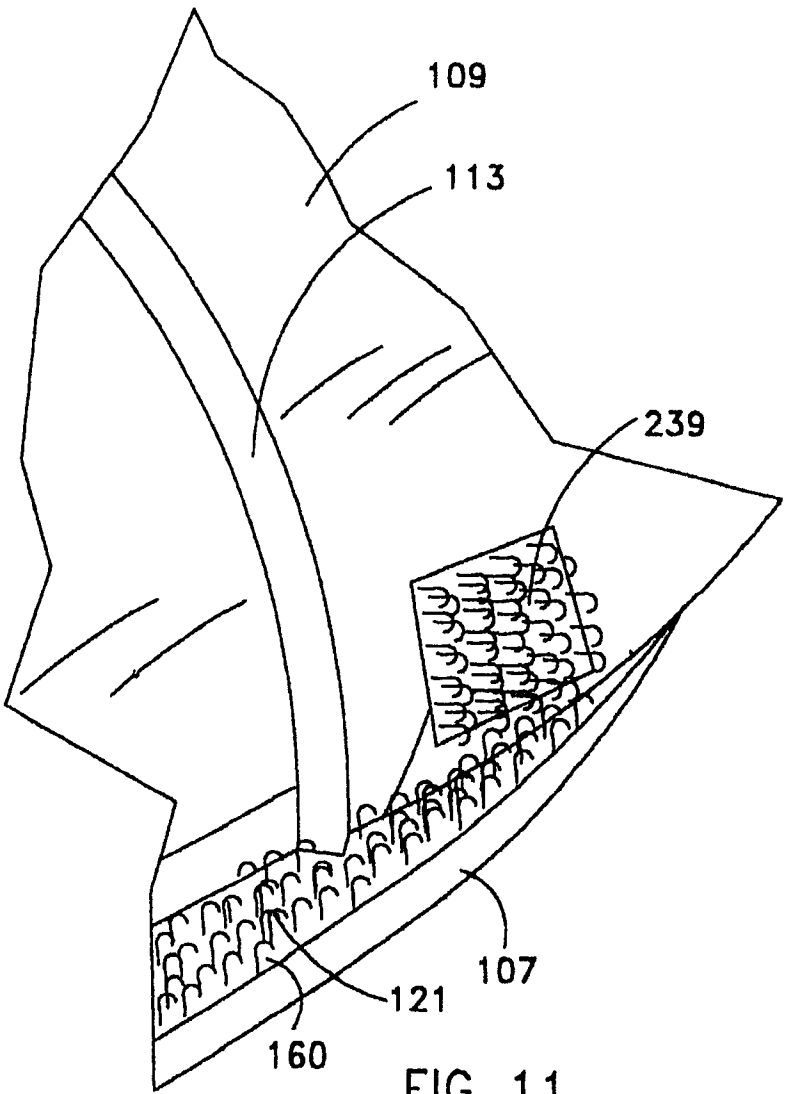
FIG. 11 shows another close-up view of the perimeter of the sole and the upper surface.
Figure 12:
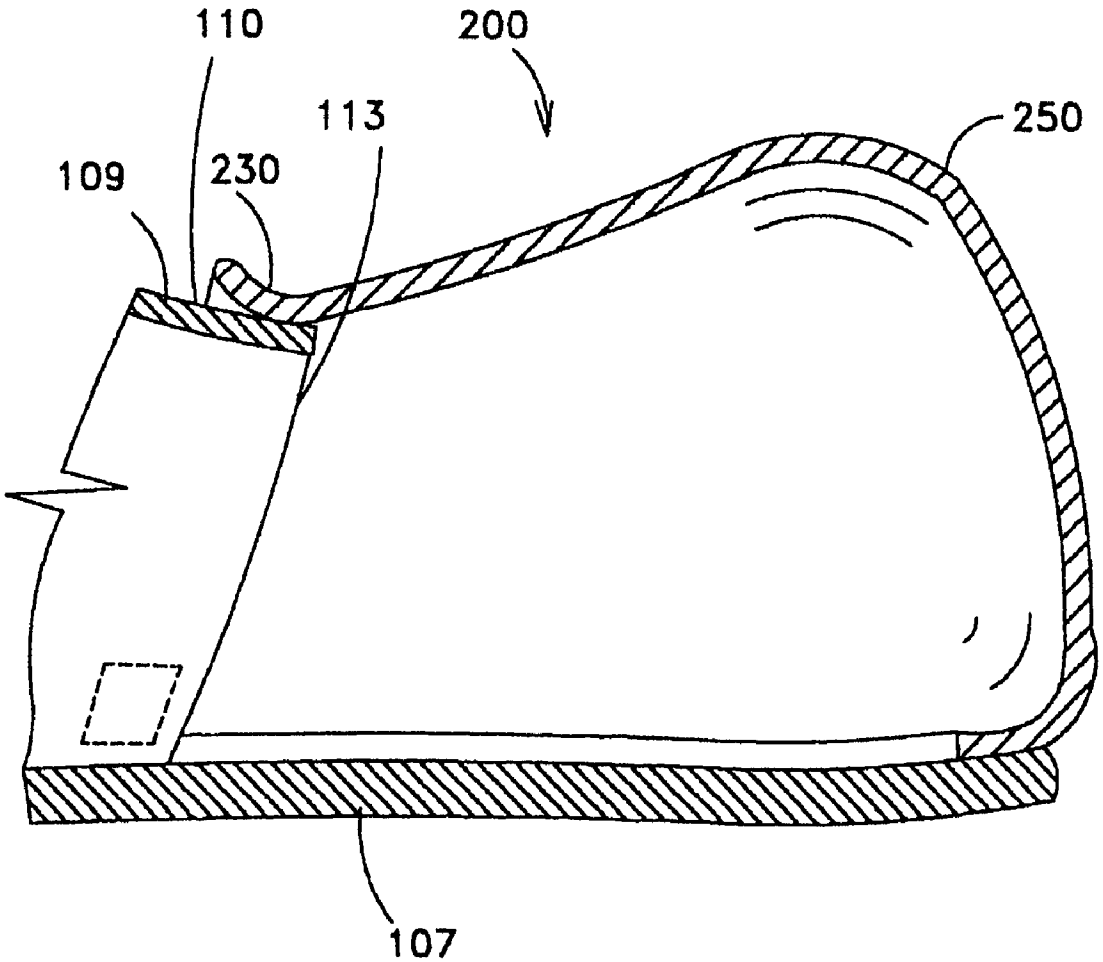
FIG. 12 shows a section view of the toe cover attached to the shoe.

The toe cover 200 includes an opening edge 230, which will rest upon the upper surface 109. The toe cover 200 further includes a bottom edge 220. The bottom edge 220 rests on a perimeter 160 of the sole 107. In other embodiments, the bottom edge 220 may rest directly on the sole or the region of the main body that supports the toes. The bottom edge 220 may include a flattened rim region 225 to receive the hook 121 and loop 221 fasteners. The bottom edge 220 may be continually or intermittently provided with the hook 121 and loop 221 fasteners. As exemplified in FIGS. 10 and 11, the perimeter 160 includes corresponding hook 121 and loop 221 fasteners to detachably receive the bottom edge 220. The perimeter 160 may also be continually or intermittently provided with the hook 121 and loop 221 fasteners. The hook 121 and loop 221 fasteners may also be recessed in the perimeter 160 of the shoe 200 for cosmetic reasons.

The opening edge 230 forms an arcuate shape to complement the arcuate shape of the edge 113. The opening edge 230 covers and rests upon the upper surface 109 of the shoe 100. A top section 233 of the opening edge 230 is not fixed or connected to a top surface 110 of the upper surface 109. This is important since the upper surface 109 and its top surface 110 need to flex and bend under the top section 233 of the opening edge 230 as the wearer walks. The top section 233 of the opening edge 230 should rest on the upper surface 109 just above a point of inflection for the toes 401. This allows the shoe to bend or flex without the toes contacting the toe cover 200 or forcing the toe cover 200 off of the shoe 100.

The hook 121 and loop 221 fasteners may cover the entire perimeter 160 or just a portion of the perimeter 160. The hook 121 and loop 221 fasteners may be used at a base 238 of the opening edge 230, but hook 121 and loop 221 fasteners should not cover the full length of the opening edge 230 or of the edge 113. Additional hook and loop fasteners may be used at a base 239 of the upper surface 109. The use of the hook 121 and loop 221 fasteners at the base 238 and the base 239 is optional. Also, the hook 121 and loop 221 fasteners at the base 238 and the base 239 may optionally be integrated into the hook 121 and loop 221 fasteners in the perimeter 160 or the bottom edge 220, respectively. It is important that the upper surface 109 be able to bend and flex under the toe cover 200.

The toe cover 200 is preferably made of a rigid, non-collapsible material. This prevents the toe cover from collapsing upon and damaging the recently pedicured toenails. The upper surface 109 of the shoe and the shoe 100 is preferably made of a softer more flexible material. This allows the shoe to flex and bend while the toe cover 200 remains generally in the original form. The toe cover 200 may have a porous structure to provide for ventilation.

Further, while the FIGS. all show the toe cover 200 being of generally rounded shape, this is by no means required and in alternative embodiments, the toe cover 200 may have an alternative shape. This is particularly relevant with the shoe 103 of FIG. 15 where a more angular or pointed shape may be desired to provide for a more upbeat design depending on current fashion trends.

The upper surface 109 will now be described in detail. The upper surface 109 holds and stabilizes the front of the foot. In a resting position, the upper surface 109 is not pulling or pressing upon the toes of the wearer. In a resting position, the upper surface is merely covering the foot. The upper surface 109 is generally not removable from the shoe 100. Instead, the upper surface 109 is a permanent and integral part of the shoe 100.

The front edge 113 of the upper surface 109 is specifically positioned to come across toes 401 to hold the toes 401 in place and thereby reduce or inhibit their upward movement. As shown in FIG. 2(B), it is desired that the edge 113 just pass over the beginning of all five toes 401, as opposed to covering an inch or more of the toes 401. The upper surface 109 will generally be sized and shaped so as to inhibit movement of the toes 401 upward as well as movement of the foot forward, generally by fitting relatively snuggly around the top of the toes 401.

As should be apparent from the above discussion, the shoe 100 provides for the ability to paint and pedicure the toes while the shoe 100 is on, and then to place the toe cover 200 over the toes so as to provide for protection of the nails. The forward region of the shoe 100 may also include additional structure to help keep the toenails from contacting the inside of the shoe structure. In particular, in the embodiment depicted in FIG. 13 there is included a toe retainer 301 that resiliently detains the toes in place against the sole 107 of the shoe. In this way, when the user walks, the toes are further inhibited from bending upward and contacting the toe cover 200. The toe retainer 301 is attached to the sole 107. The toe retainer 301 in FIG. 13 is designed to retain the toe by holding the toe to the sole 107.

Figure 13:
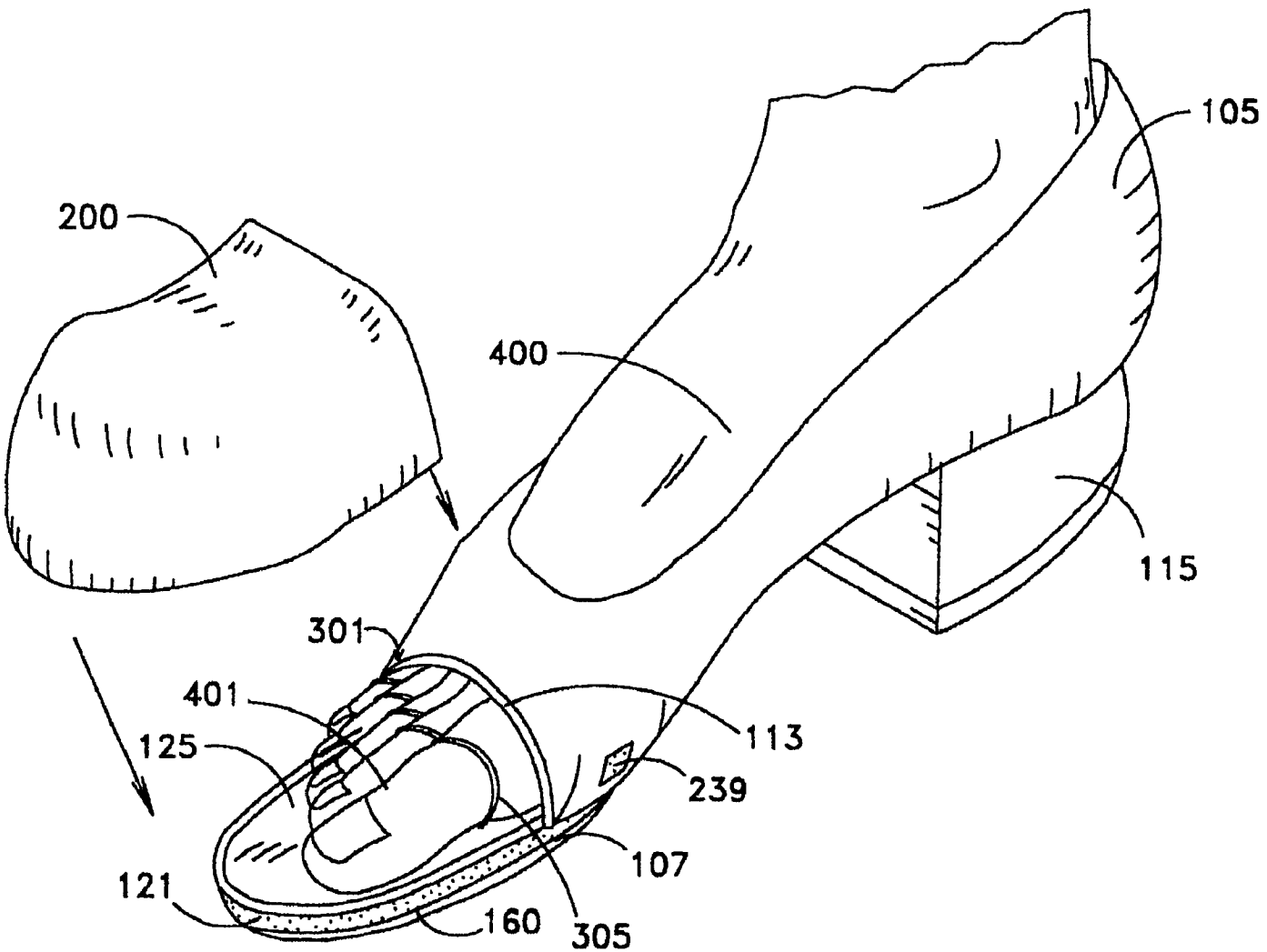
FIG. 13 shows a view of the shoe with a toe retainer.

In the embodiment of FIG. 13 the toe retainer 301 comprises one or more loops 305 attached to the sole 107 of the shoe 100. The loops 305 are sized and shaped to be placed over the toes. It is preferred that five loops 305, one for each toe, be used, but in an alternative embodiment multiple toes could be placed into the same loop 305. When the shoe 100 is put on, the toes will be slid into the appropriate loop 305 placing the loop 305 behind the toenail, generally in the region of the middle or proximal row of phalanges behind the toenail. The toe is then effectively tied to the sole 107 of the shoe 100 and will remain in contact with the shoe 100. The loops 305 may either be permanently attached to the sole 107 or may be removably attached so that they can be released to allow the toes increased movement once the nail polish has dried. In operation, the shoe 100 would be used as follows. The user would generally have her pedicure completed up until the application of polish to the toenails, which is usually the last step. The foot would then be placed into the shoe 100 with the toe cover 200 removed. The toenails can therefore be accessed by the person performing the pedicure who can paint the toenails while the foot is in the main body 101 of the shoe 100. Once the painting process is completed to satisfaction, the polish would generally be allowed to dry for as long as possible with the toe cover 200 removed and the user remaining sedentary.

Once the user is ready to leave the spa, she will reconnect the toe cover 200 to the shoe 100 completing the shoe's look and making it appear to be a singular structure. The upper surface 109 or toe retainer 301 will keep the toes from fully curling upward and impacting or touching an inner surface 201 of the toe cover 200. Further, as the main body 101 retains the heel and ankle, the foot will generally be unable to slide forward or rearward in the shoe 100 any significant distance also inhibiting damage to the nails. Thus, even wet polish on the toes will be inhibited from contacting the inner surface 201 of the toe cover 200.

The shoe 100 is generally designed so that a user can walk relatively normally while wearing the shoe 100 without being concerned about potential damage to the nail polish. Further as the toes are now relatively encased by the shoe 100 (specifically the toe cover 200, the polish is also protected from external conditions of concern. In particular, the design of the shoe 100 can ward off dust and particulates In order to better improve and accelerate polish drying while the toe cover 200 is in place, the shoe 100 may include an inconspicuous ventilation system. In an embodiment, there may be small holes, generally located towards the upper-sides of the shoe 100 to inhibit the entrance of dust, particulates or surface water, placed in the shoe 100. The holes will generally be located in the main body 101 around the middle of the foot, but may also be located in the upper surface of the toe cover 200. The holes will allow air to pass in and out of the shoe 100 accelerating the drying of the nail polish. Movement of the shoe 100 during walking can further enhance airflow into and out of the holes. This can also improve drying by providing a generally dryer environment inside the shoe 100 which can also improve the resultant quality of the polish appearance. These holes can be incorporated into a design for the shoe 100 and can be sized and shaped to minimize or eliminate water intrusion even in wet conditions.

The shoe 100 will generally be designed to be worn after a pedicure to camouflage that a pedicure has been obtained and therefore will need to be useable in a wide variety of circumstances. In particular, the user may need to go to work or otherwise be out and about after the pedicure. The shoe 100, therefore, will preferably be both functional for use in a variety of conditions, and have an aesthetical appearance suitable for a variety of situations. In particular, in an embodiment of the invention, the function and structure of the shoe 100 can be disguised by outward appearance so it is not apparent that the shoe 100 is for protecting a pedicure.

To meet this intent, the shoe 100 may be designed utilizing any popular style of shoe and may be provided with an athletic, professional, or elegant design. The shoe 100 may include decorative accessories such as stones, bows, etc. The style of the shoe 100 may change to accommodate different tastes in shoes or depending upon the designer's discretion. It may also include a variety of structural elements suitable for different tasks. For instance specially designed soles and comfort mechanisms, as known to those of ordinary skill in the art, may be provided to allow the shoe 100 to be worn for a significant period of time, even if such length of time is beyond that necessary for the polish to dry.

In another embodiment, a single shoe 100 may provide a variety of styles and options. In an embodiment, the toe cover 200 is interchangeable with other toe covers 200 providing for a single shoe 100 with a multitude of appearances and styles and potential functionality. For instance, the shoe 100 may be constructed of a fairly solid color scheme without significant decoration. A plurality of toe covers 200 may be provided which match or complement the main body color, but include surface decoration of many different styles.

Figure 14:
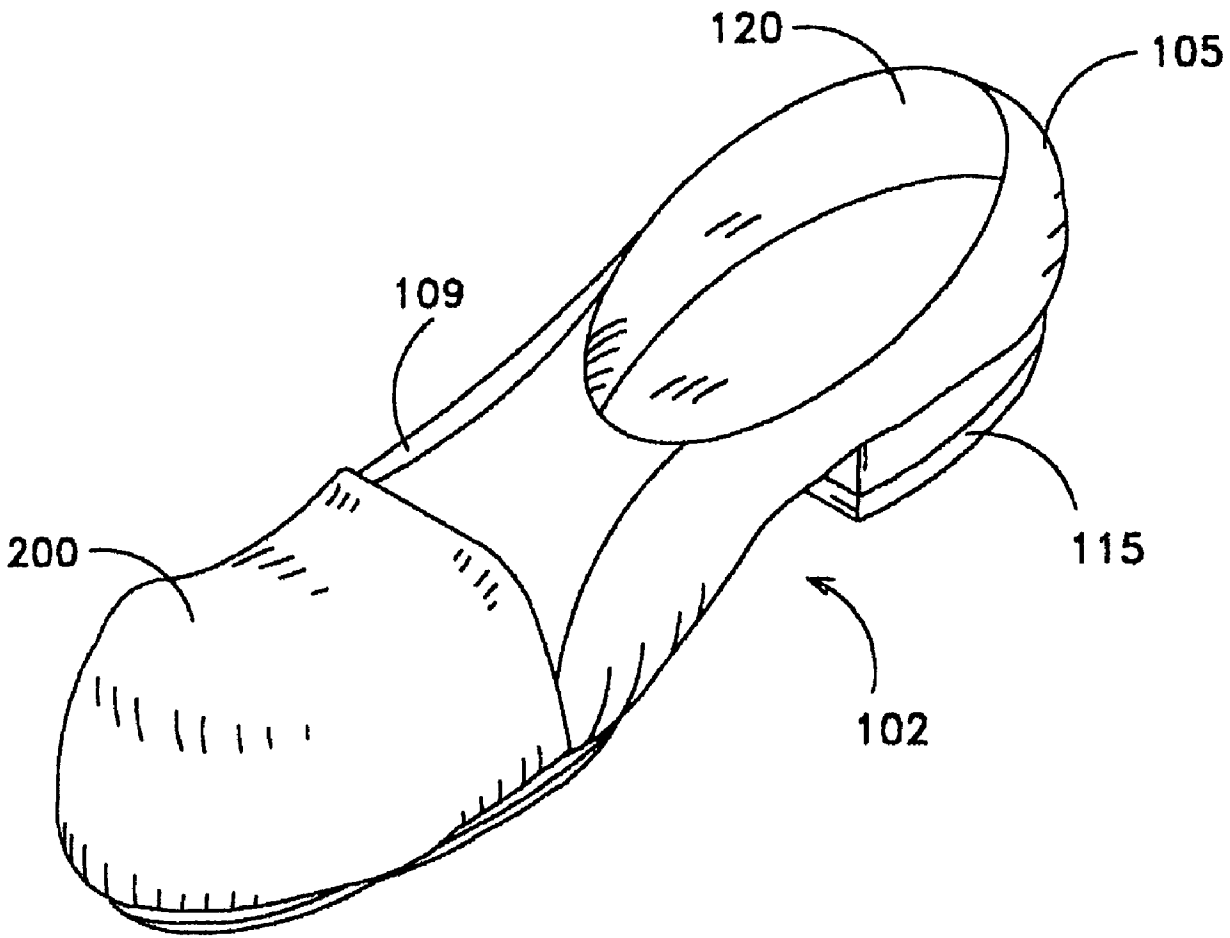
FIG. 14 shows a view of the casual shoe with the toe cover in place.

Another embodiment of the present invention is shown in FIG. 14. This embodiment is a casual shoe 102 version of the present invention suitable for casual occasions. The general surrounding structure of the casual shoe 102 shown in FIG. is maintained in a similar manner to shoe 100 shown in FIGS. 1 through 13. The casual shoe 102 has a shorter heel and a larger upper surface 109. The casual shoe 102 version functions in the same manner as shoe 100.

Figure 15:
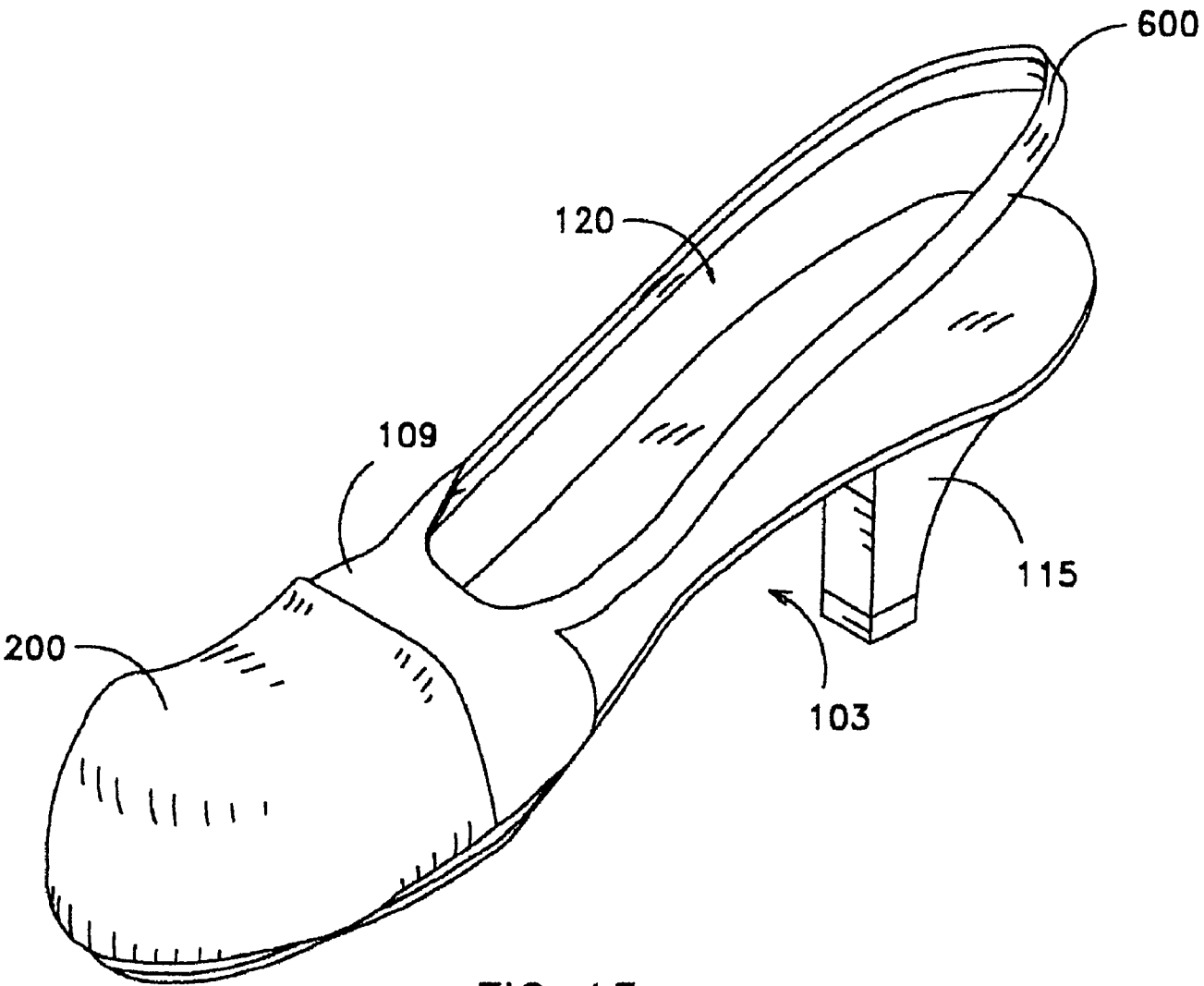
FIG. 15 shows a view of the fashionable shoe with the toe cover in place.

A still further embodiment of the present invention is shown in FIG. 15. This embodiment is a fashionable shoe 103 version of the present invention, suitable for dress-casual events such as a cocktail party. The general surrounding structure of the fashionable shoe 103 shown in FIG. 15 is maintained in a similar manner to shoe 100 shown in FIGS. 1 through 13. The fashionable shoe 103 has a narrower heel and a smaller upper than the shoe 100. The fashionable shoe 103 version functions in the same manner as shoe 100, however, the rear 105 of the fashionable shoe 103 may comprises a strap 600 or other structure to prevent backward movement of the foot. The strap 600 wraps around the heel or back of the foot. The foot is still securely retained in the fashionable shoe 103, even though much of the side and rear material has been removed and replaced with the strap 600 to give a different style appearance.

A still further embodiment of the present invention includes a hidden engaging mechanism, such as, a magnetic strip hidden inside or under the material forming the upper surface 109. The magnetic strip would then mate to an oppositely charged magnetic strip in the perimeter of the sole 160. The hidden engaging mechanism serves the same purpose as the hook 121 and loop fasteners 221, but allows the connection to be hidden from view, even when the toe cover 200 is removed. This can provide for still further style options because it allows the shoe to be worn open-toed once the nail polish has dried sufficiently while still camouflaging the shoes purpose.

Further embodiments of the present invention will now be described.

Figure 16:
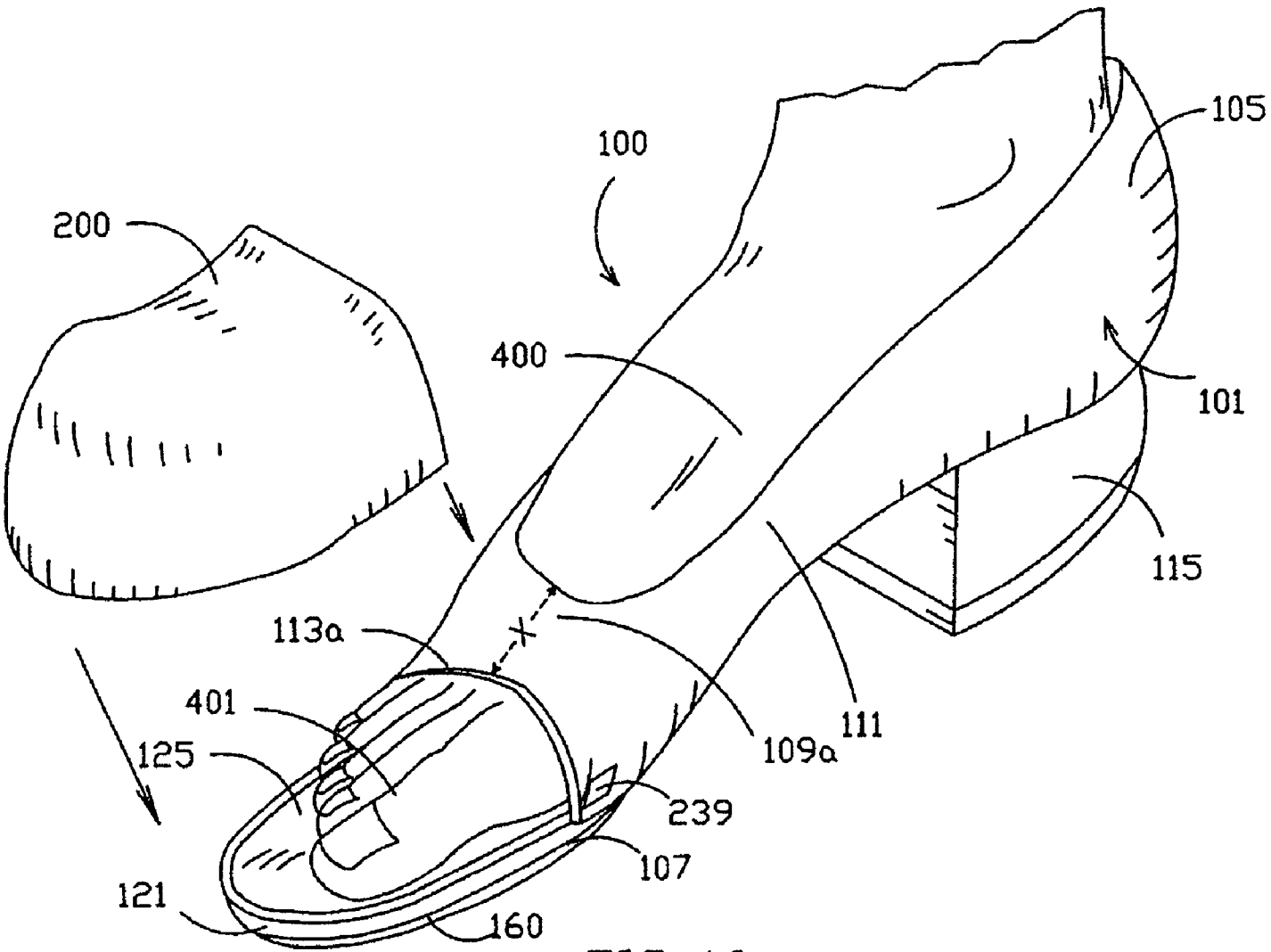
FIG. 16 shows a view of the shoe with a modified front edge and upper surface.

With reference to FIG. 16, the shoe 100 is shown with a modified edge 113A and a modified upper surface 109A. In this embodiment, the edge 113A is moved back slightly on the toe or the toe/foot junction towards the heel of the foot. This configuration reduces the distance shown as "X" in FIG. 16 between the edge 113A and an edge of the upper surface 109A contacting the foot 400. The distance X of the shoe of FIG. 16 may be approximately 5 percent to approximately 30 percent smaller than the corresponding distance of the shoe shown in FIGS. 1-12. The edge 113A and the upper surface 109A assist in providing a shoe 100 that accommodates individuals with longer toes 401. By decreasing the distance X, the toes 401 of an individual having longer toes are less likely to contact any interior surfaces of the toe cover 200 or the edge 113A to reduce the likelihood of damaging the pedicure. Shoes 100 of the present invention may be manufactured with the edge 113 or the edge 113*a* to better provide the consumer with a properly fitting shoe 100.

With reference to FIGS. 17A-17D, the shoe 100 is shown with removable toe loops 305. Depending on the user preference and the anatomical shape of the user's toes, one to five toe loops 305 may be removably inserted into the front region 125 of the shoe 100. The user may insert the one to five toe loops 305 at any or all of five receiving portions 306, for example, the user may prefer just a single toe loop 305 for the big toe or three toe loops 305 for the second through fourth toes. The toe loops 305 help reduce the upward and lateral movements of the toes 401 inserted therein. The toe loops 305 assist in tying the toes 401 to the shoe 100. Some individuals may not require the use of the toe loops 305, however others may appreciate the extra immobilization it provides to the toes 401. The shoe 100 may be supplied to the consumer with the five toe loops 305, which may be used at the discretion of the consumer.

When the consumer chooses to utilize the toe loops 305, the consumer removably attaches the toe loops 305 to the receiving portions 306 in the front 125 of the shoe 100. The toe loops 305 should preferably be attached to the shoe 100 prior to the performance of the pedicure. The consumer inserts their toe 401 or toes 401 into the toe loops 305.

The structure and function of the receiving portion 306 will vary depending on the specific type of toe loop 305 employed by the shoe 100. The receiving portion 306 is preferably imbedded or sunk into the bed of the front 125 of the shoe 100 to prevent the receiving portion 306 from causing the consumer discomfort.

Figures 17A, 17B, 17C, 17D:
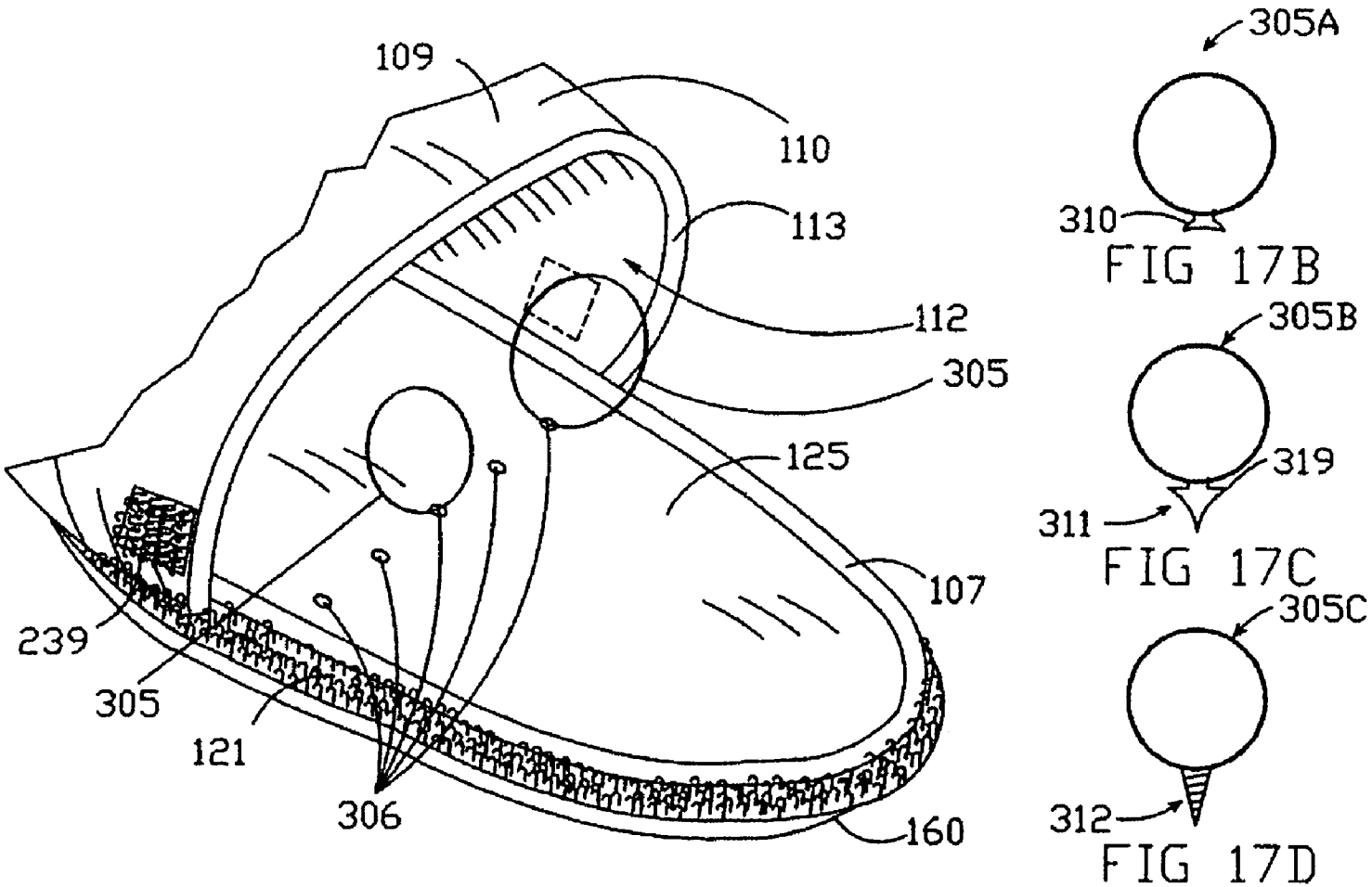
FIG. 17A shows a view of the shoe with the removable toe loops.
FIG. 17B shows a removable snap-in toe loop.
FIG. 17C shows a removable toe loop with a prong that is received by the shoe.
FIG. 17D shows a removable toe loop that screws in to the shoe.
Figure 18:
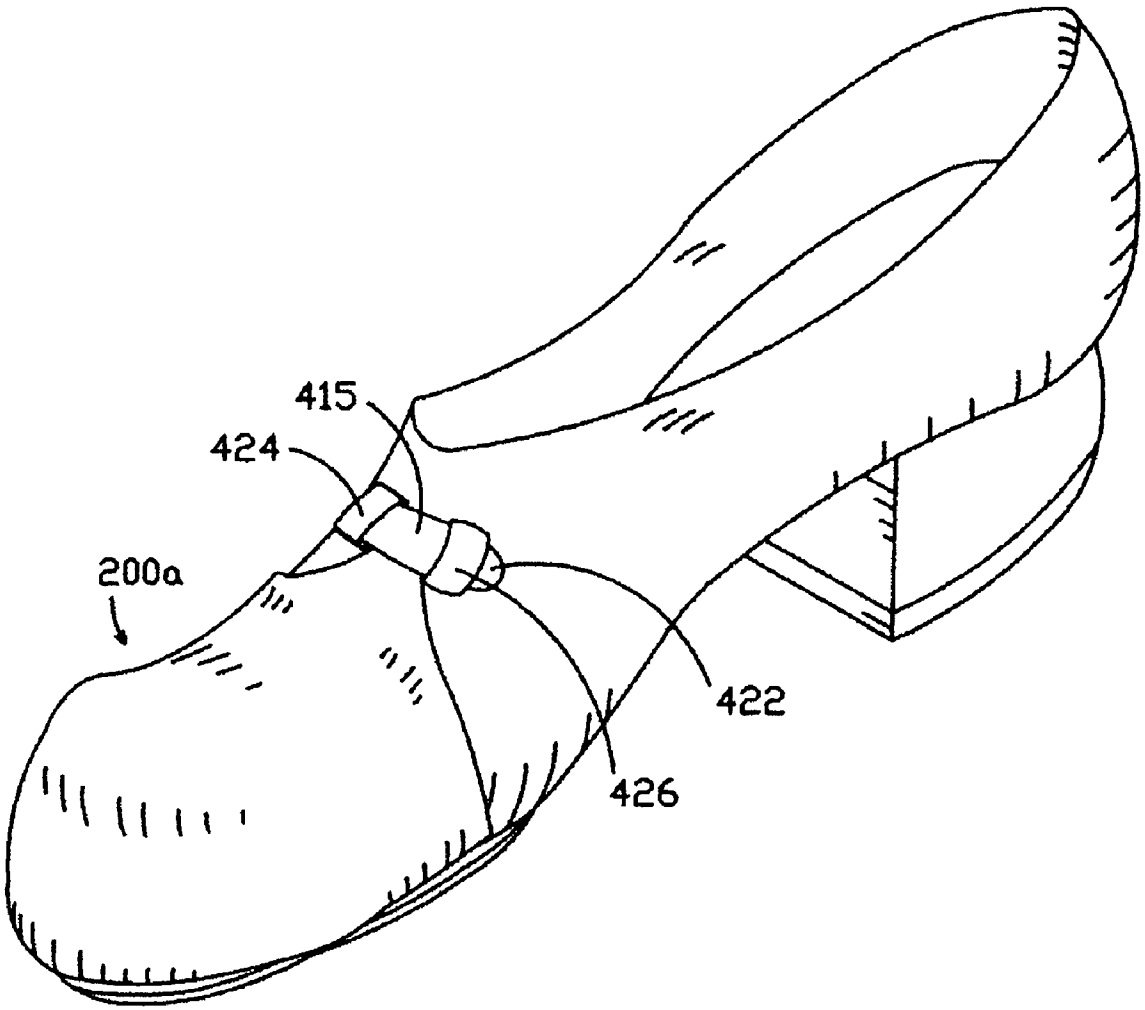
FIG. 18 shows a view of the shoe with the narrowing member.
Figure 19:
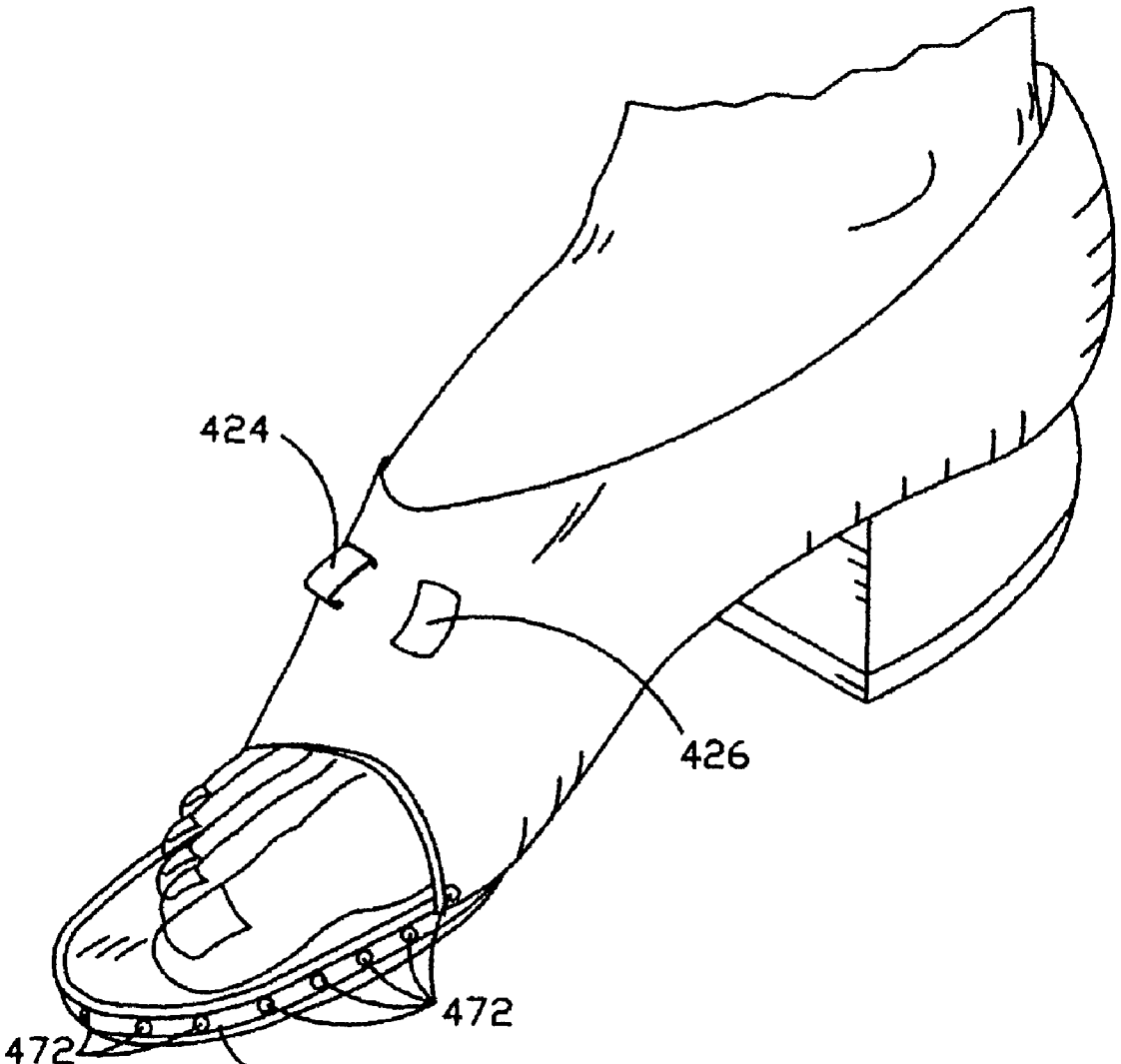
FIG. 19 shows a view of the shoe that receives the narrowing member.
Figure 20:
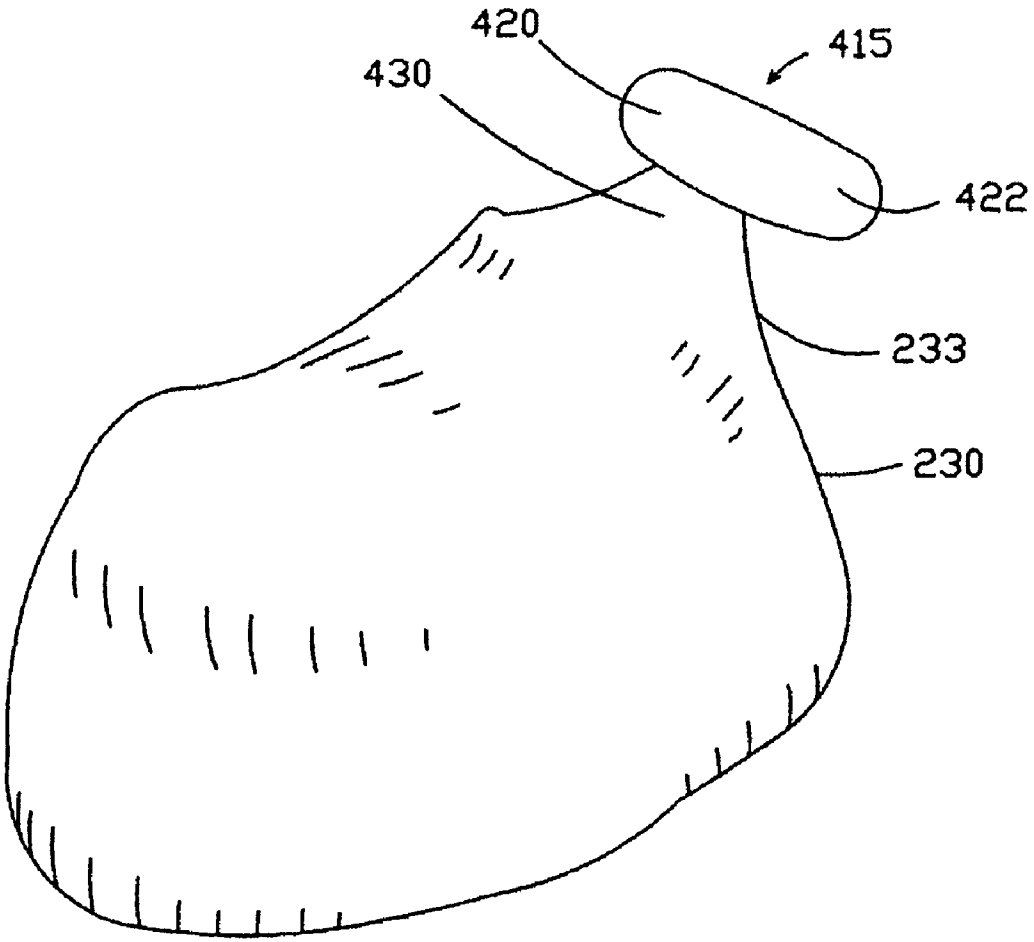
FIG. 20 shows a view of the toe cover with the narrowing member.
Figure 21:
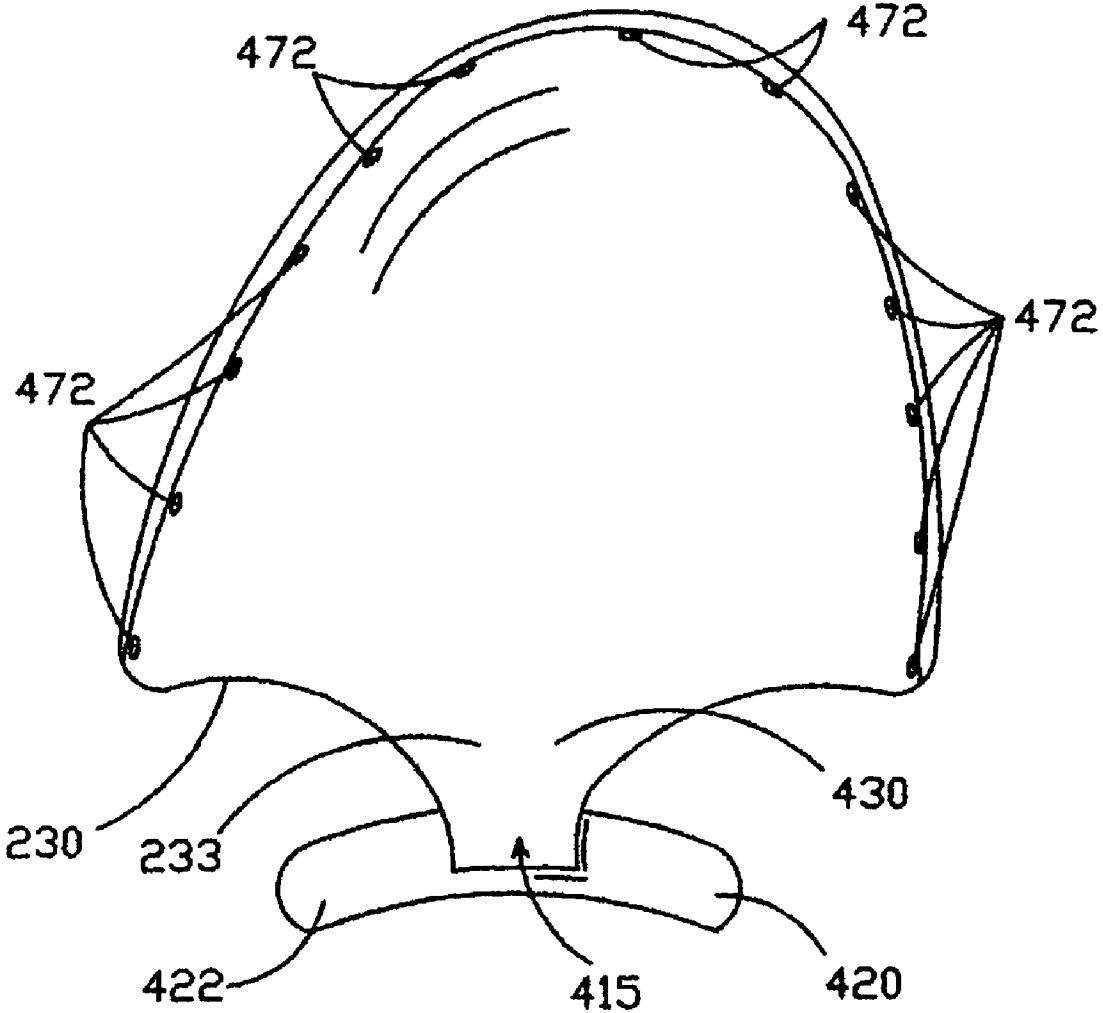
FIG. 21 shows a bottom view of the toe cover with the narrowing member.

With reference to FIG. 17A, a toe loop 305A includes a snapping mechanism 310 that snaps the toe loop 305A to the receiving portion 306. The toe loop 305A may alternately include the male or female portion of the snap. At the discretion of the consumer, the toe loop 305A may be unsnapped and removed from the receiving portion 306.

With reference to FIG. 17B, a toe loop 305B is shown that includes a prong 311 that is inserted into the receiving portion 306 to fasten the toe loop 305B to the front 125 of the shoe 100. The prong 311 includes a barb portion 319 to increase the frictional connection between the toe loop 305B and the receiving portion 306. At the discretion of the consumer, the toe loop 305B may be pulled and removed from the receiving portion 306.

With reference 17C, a toe loop 305C is shown including a screw member 312. The screw member 312 is threadably received by the receiving portion 306. At the discretion of the consumer, the toe loop 305C may be unscrewed and removed from the receiving portion 306.

The present invention is not limited to a particular manner of fastening the toe loop 305 to the front of the shoe 125. One of ordinary skill in the art will recognize that other fastening means may be utilized to removably attach the toe loop 305 to the front 125 of the shoe 100, including buttons, ties, laces, hook/loop fasteners and other customary connection means. In some embodiments of the present invention, the toe loops 305 may be permanently affixed or attached to the bed of the front 125 of the shoe 100.

The toe loop 305 includes a loop or a circle of a material that encircles the toe 401. The material may include leather similar to the remainder of the shoe, or a rigid, flexible, or semi-flexible natural material or synthetic material, such as elastic or nylon, that holds the toe 401 to the front of the shoe 125.

With respects to FIGS. 18-21, a toe cover 200A is shown with a narrowing member 415. In general, the narrowing member may be any structure affixed or integral with the top of the toe cover 200 or the upper surface 109 that provides a narrowing function to the appearance of the shoe 100. In the embodiment shown in FIGS. 18-21, the narrowing member 415 is integral or connected to the toe cover 200A via a transition region 430, which extends from the top section 233 of the opening edge 230. The transition region 430 and the top section 233 rest upon the upper surface 109 similar to other embodiments of the present invention.

In the embodiment of FIGS. 18-21, the narrowing member 415 includes oppositely disposed lateral portions 420 and 422. These lateral portions 420 and 422 are received by receiving members 424 and 426 on the surface of the upper surface 109. In this embodiment, the receiving members 424 and 426 are in the form of loops that are penetrated by the lateral portions 420 and 422, respectively.

Preferably, the receiving portions 424 and 426 of the narrowing member 415 are positioned on the top center part of the upper surface 109. Use of the narrowing member 415 is not required for the operational functionality of the shoe, however, it serves an important aesthetic function, namely the narrowing member detracts the attention of observers from the "wide body" of the toe cover 200A and front portion 125 of the shoe 100. The narrowing member 415 creates an optical illusion, which improves the aesthetic nature of the shoe, i.e., the toe cover 200A does not appear to the observer to be as large as it is.

One of ordinary skill in the art will recognize that other configurations for the narrowing member may be employed on the shoe 100. The narrowing member provides an extra structure to the shoe 100 that provides the optical illusion of narrowness. For example, the narrowing member may snap to both the toe cover 200 and the upper surface 109. For example, the narrowing member may lack the lateral portions 420 and 422 received by the receiving member 424 and 246.

A plurality of magnets may also be used to engage the toe cover 200 to the shoe 100. The magnets are placed at the front portion or the front inside portion of the shoe 100, or the magnets may be in the front of the shoe's insole—so the magnets would be inconspicuous. In the embodiment shown in FIGS. 18-21, a plurality of magnets 472 are used for attaching and detaching the toe cover 200*a*. In the embodiment of FIGS. 18-21, the magnets 472 are integral with or attached to a side 470 of the front surface 125 of the shoe 100. Correspondingly, oppositely charged magnets 472 are placed in walls 205 of the toe cover to interact with the magnets 472 in the side 470 of the shoe 100. The magnets 472 may be affixed or integral to or in the side 470 of the shoe 100. In certain embodiments, the magnets 472 may include a decorative feature, such as a color or specific shape, to improve the aesthetic appearance of the shoe, if the shoe is worn without the toe cover in a sandal fashion. As with other embodiments of the present invention, different engaging mechanisms may be used to attach the toe cover 200 to the shoe 100. For example, the individual magnets 472 may be replaced with strips of magnets. For example, a zipper structure may be employed. Removable adhesives, hook/loop fasteners, buttons, zippers, ties, snaps or other structures known to those of ordinary skill in the art may be also employed as the engaging mechanism.

Figure 22A:
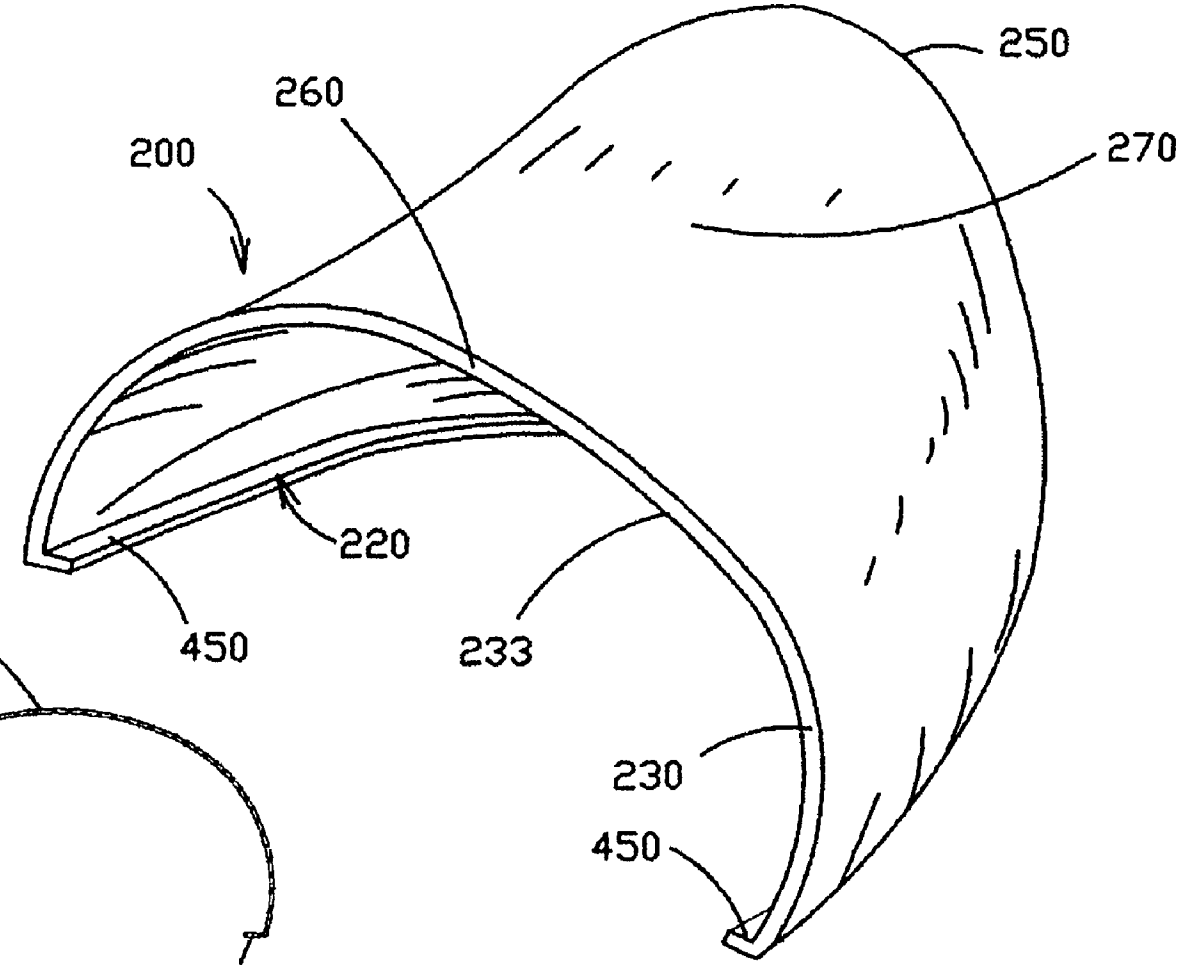
FIG. 22A shows a view of the toe cover with the rim.
Figure 22B:
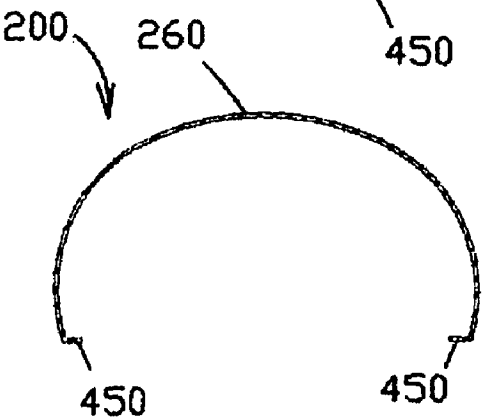
FIG. 22B shows a cross-section view of the toe cover with the rim.
Figure 23:
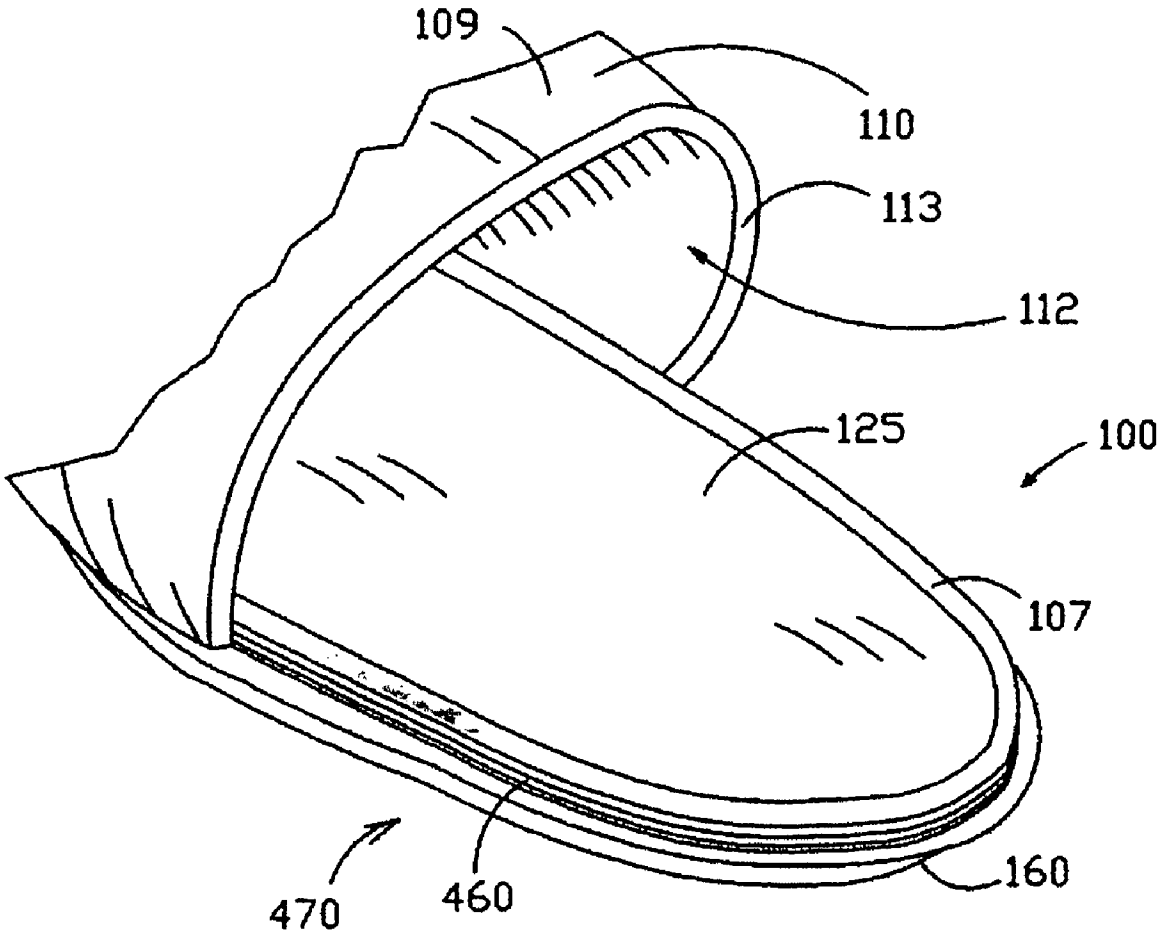
FIG. 23 shows the shoe with a groove to receive the rim of the toe cover.

FIGS. 22A and 22B show a toe cover 200 with a rim 450. The rim 450 extends from the toe cover 200 near the bottom edge 220 of the toe cover 200. In the embodiment shown in FIGS. 22A and 22B, the rim 450 extends in a generally perpendicular manner from the bottom edge 220 of the toe cover 200. In this embodiment, the rim 450 extends most of or the entire length of the bottom edge. The toe cover 200 is engaged to the shoe via the cooperative interaction of the rim 450 and the groove 460. Specifically, the rim 450 is received by a groove 460 (shown in FIG. 23) on the side 470 of the front portion 125 of the shoe 100. This arrangement provides a positive locking mechanism to securely attach and detach the toe cover 200 from the shoe 100. The rim 450 may further include a broadened portion at the end at the rim 450 that anchors the rim 450 into the groove 460.

In certain embodiments, the rim 450 includes a plurality of separate rim members extending from the toe cover 200 that are received by the groove 460 or a plurality of grooves. This embodiment may employ two to twenty or more different rim members.

Figure 24A:
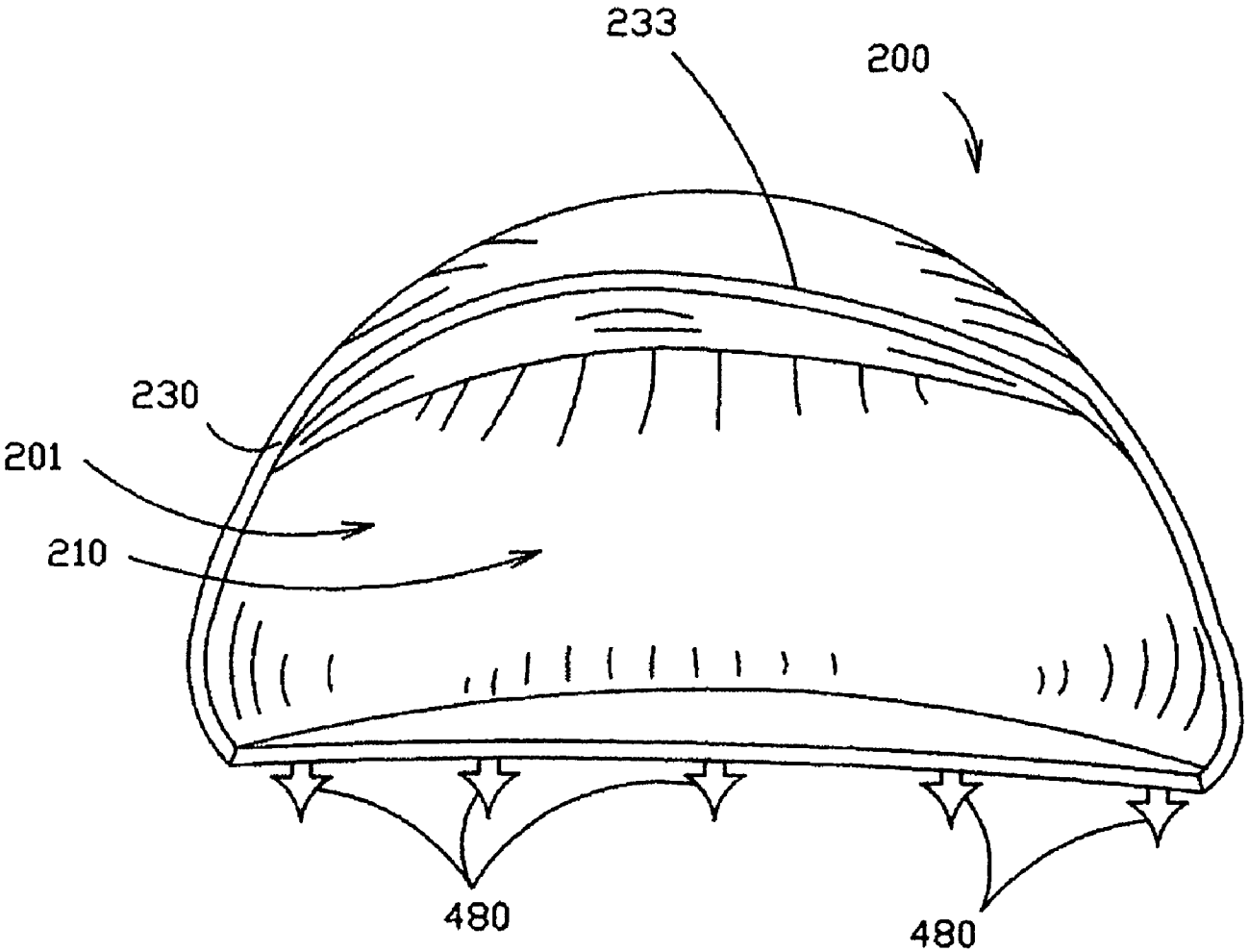
FIG. 24A shows a view of the toe cover with prongs.
Figure 24B:
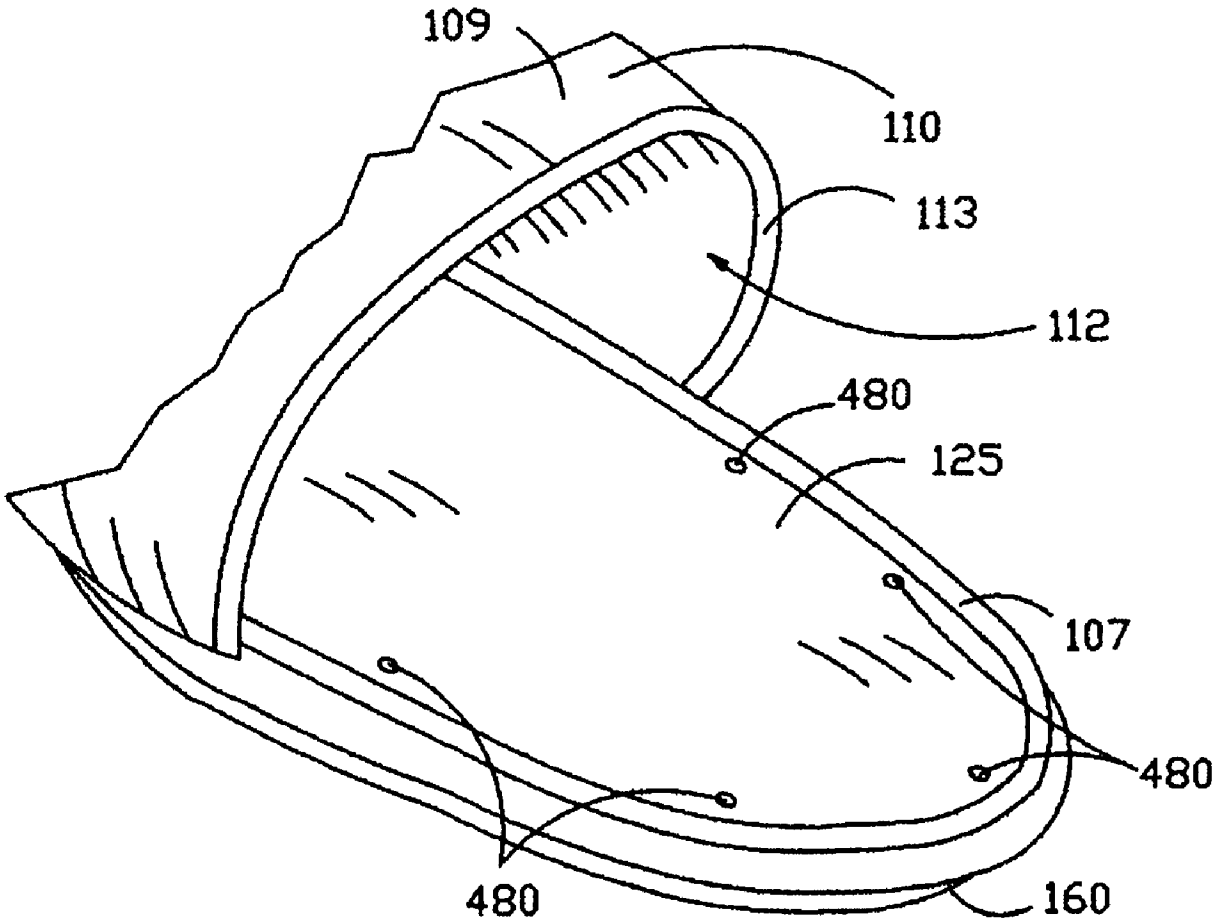
FIG. 24B shows the shoe with holes to receive the prongs.
Figures 25A, 25B:
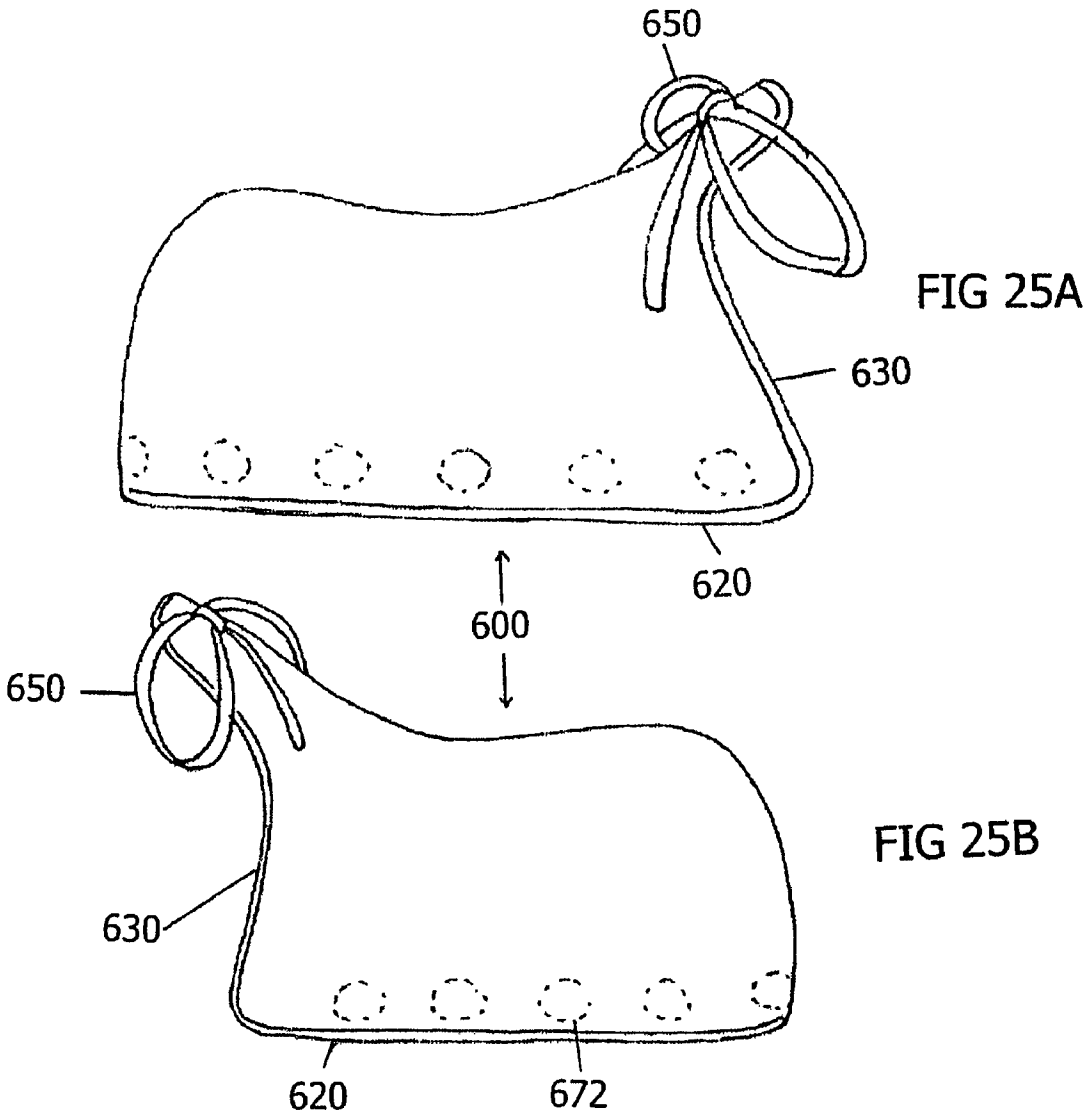
FIGS. 25A and 25B show side views of the toe cover with magnet attachment.
Figure 26:
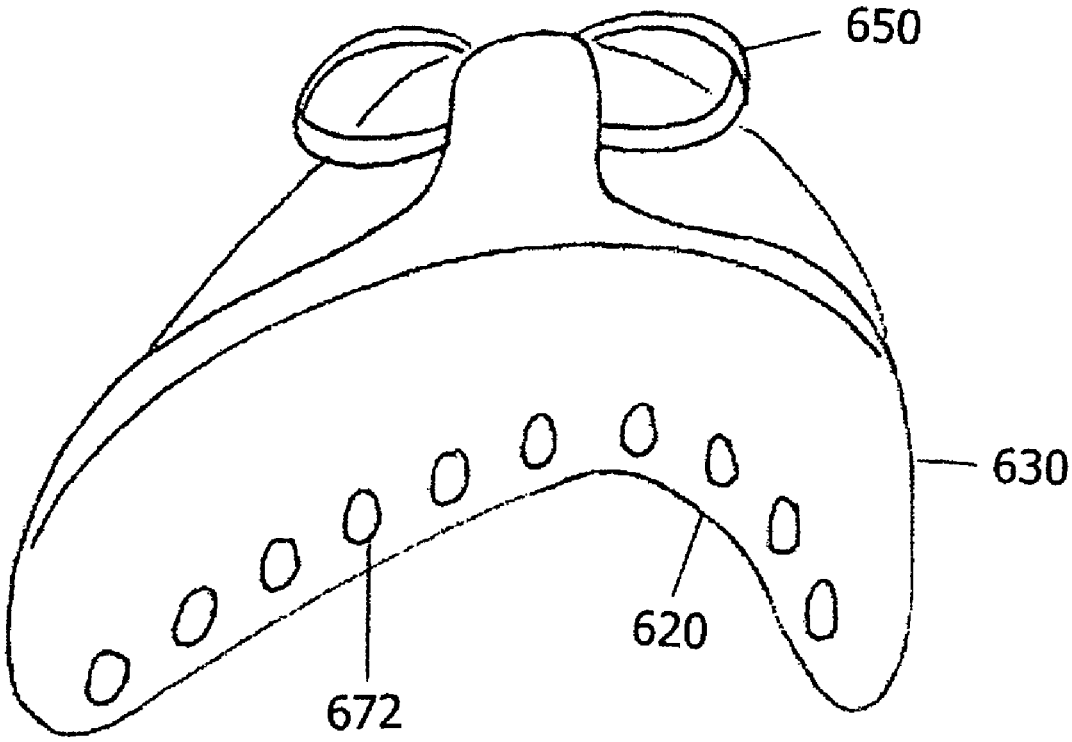
FIG. 26 shows an inside view of the toe cover with magnet attachment.
Figure 27:
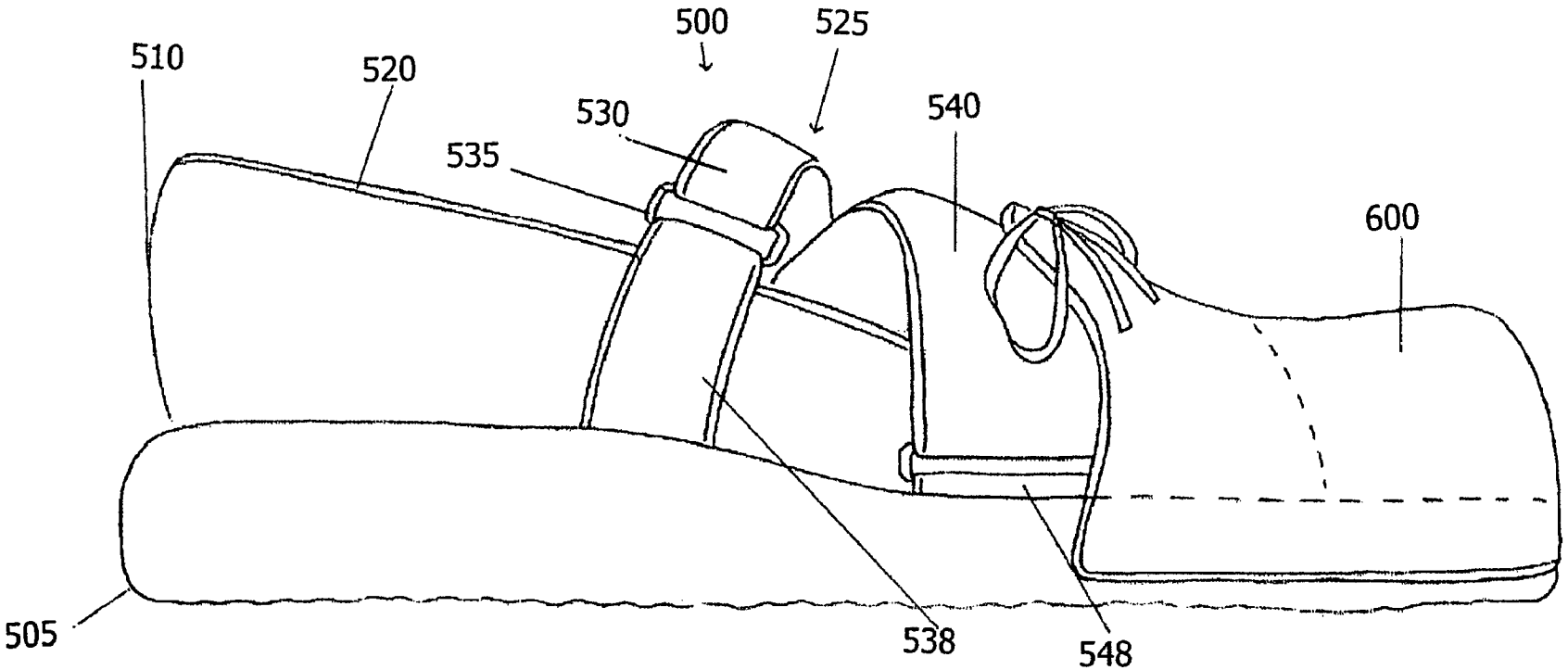
FIG. 27 shows an inside view of the shoe with the adjustable upper.
Figure 28:
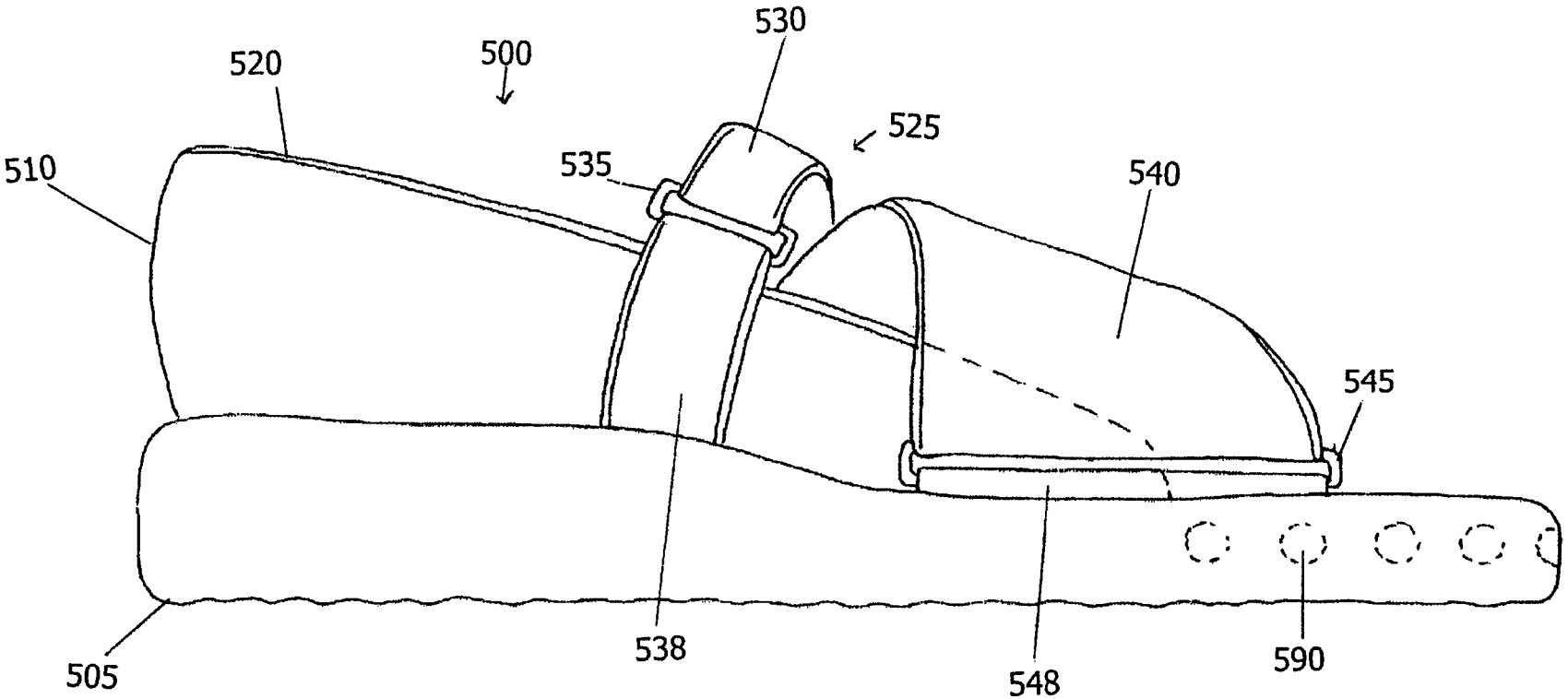
FIG. 28 shows an inside view of the shoe with the adjustable upper with the toe cover removed.
Figure 29:
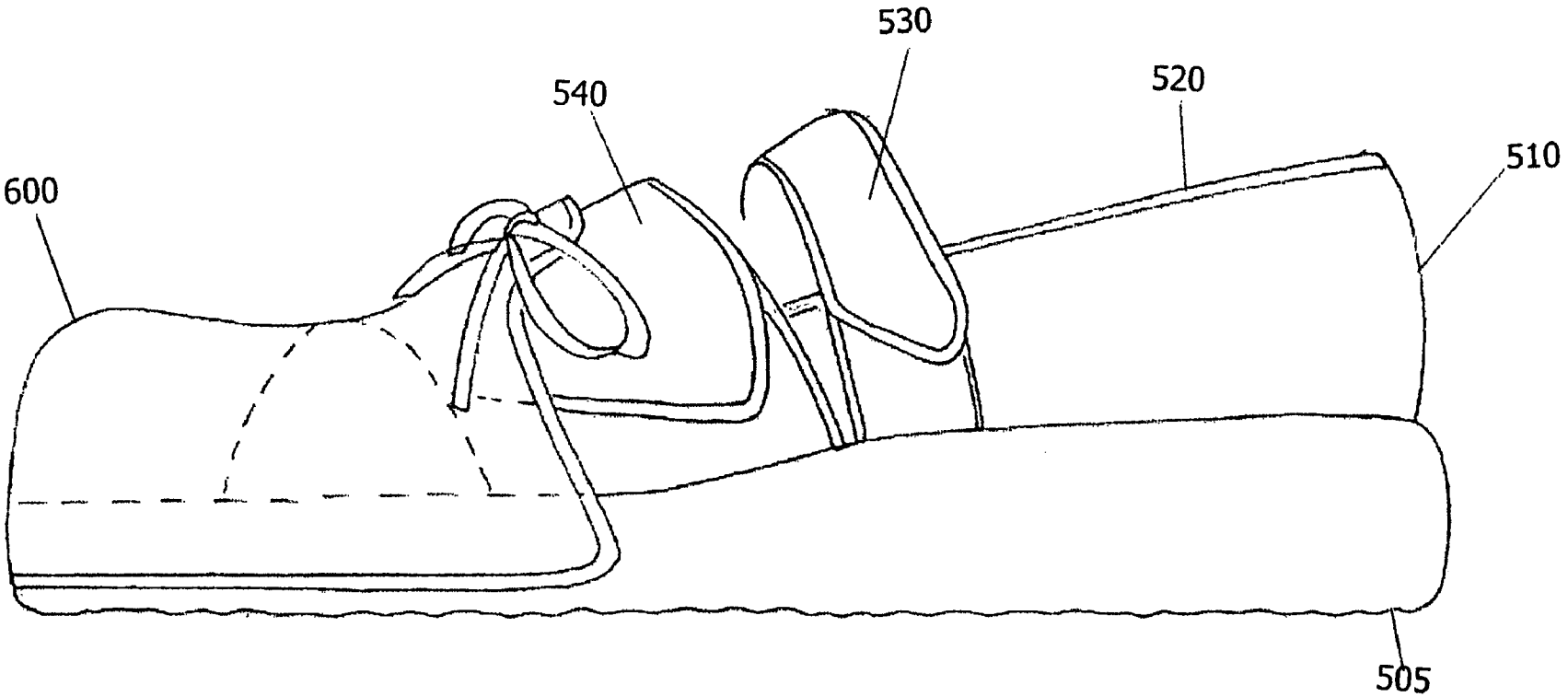
FIG. 29 shows an outside view of the shoe with the adjustable upper.
Figure 30:
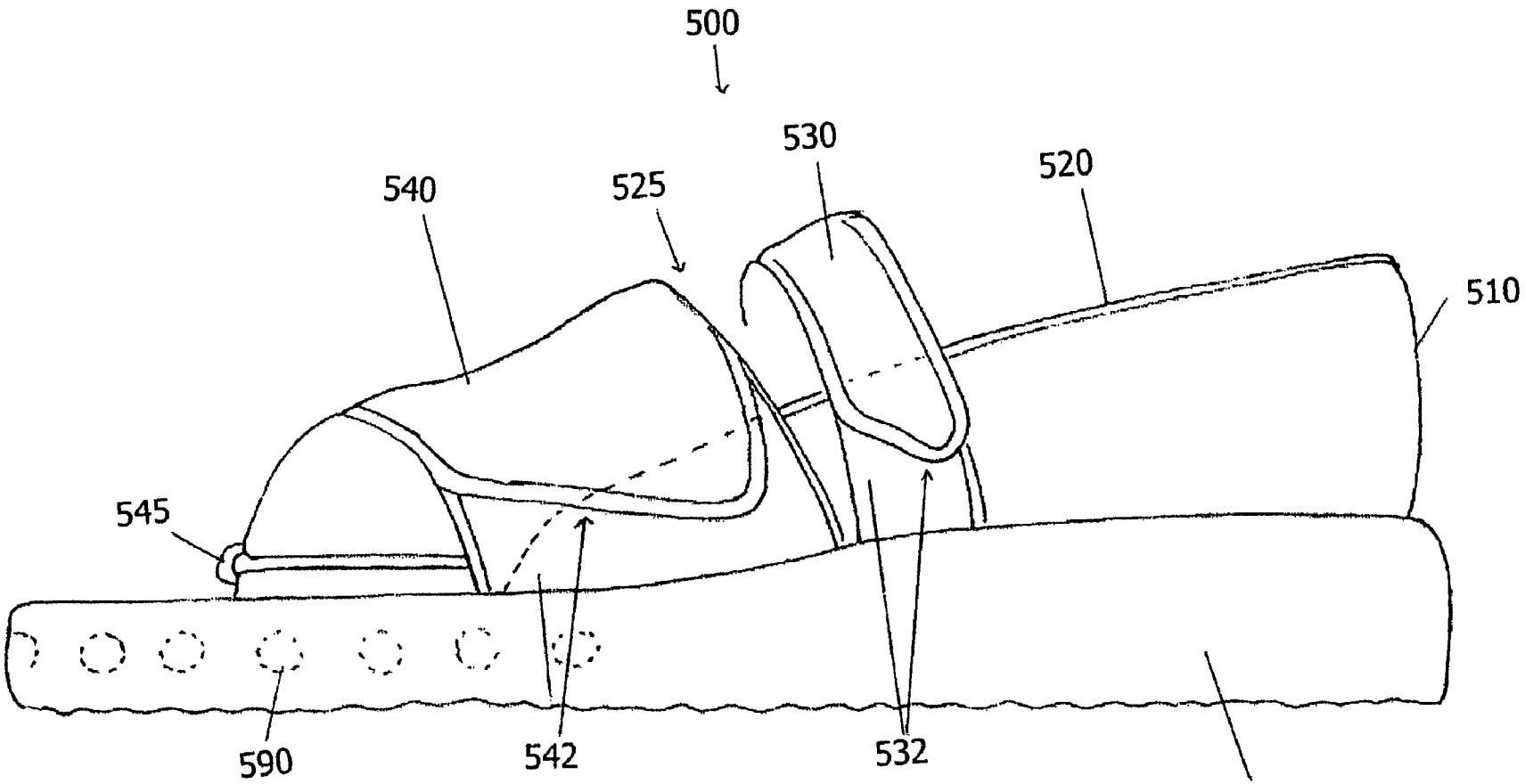
FIG. 30 shows an outside view of the view with the adjustable upper with the toe cover removed.
Figure 31:
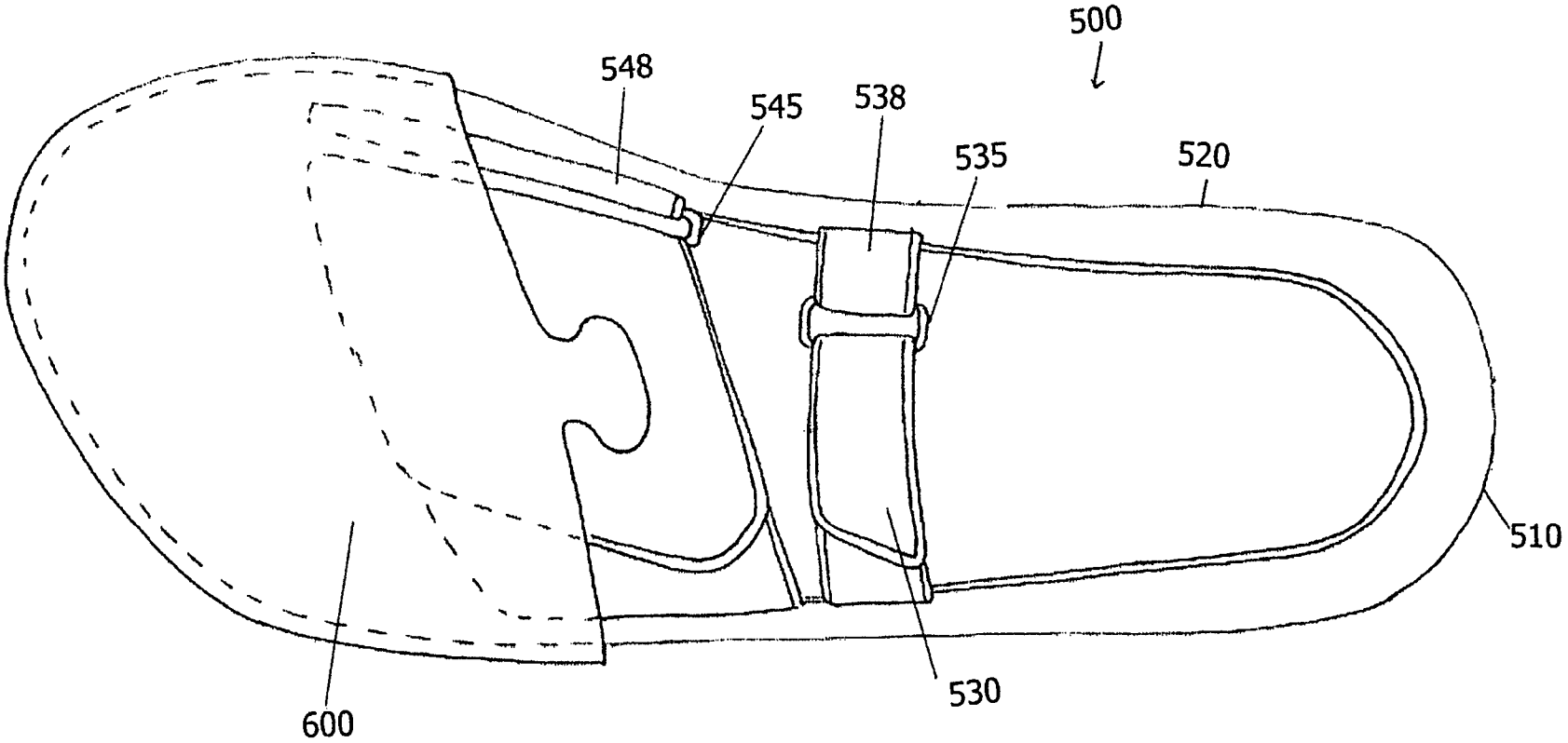
FIG. 31 shows a top view of the shoe with the adjustable upper.
Figure 32:
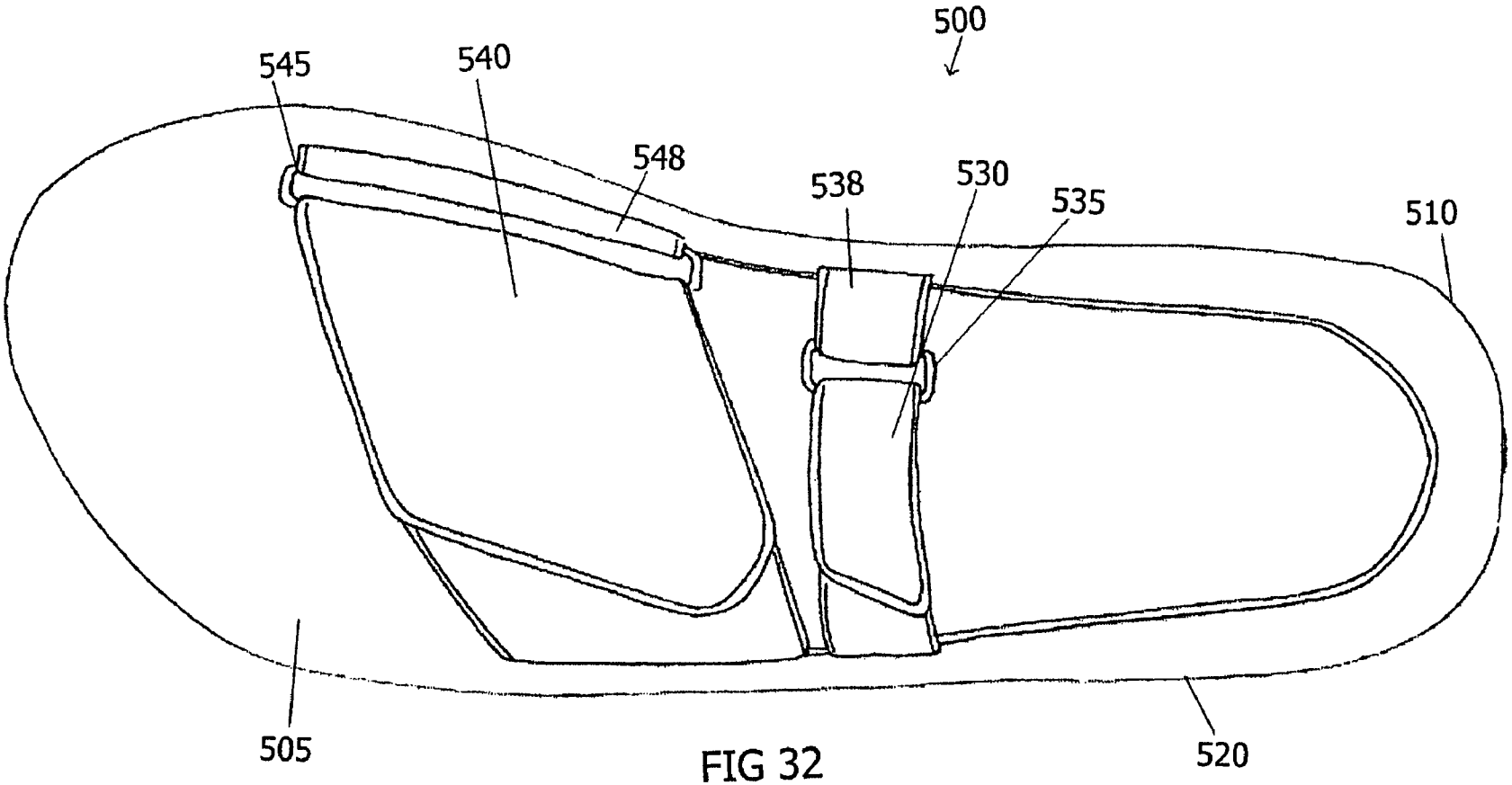
FIG. 32 shows a view of the shoe with the adjustable upper with the toe cover removed.

FIGS. 24A and 24B show a further embodiment of the toe cover in which prongs 480 extend from the bottom edge 220 of the toe cover 200. These prongs are inserted into holes 490 in the perimeter 160 of the shoe 100. The holes 490 frictionally hold the prongs 480 to secure the toe cover 200 to the shoe 100.

Another embodiment of the footwear is shown in FIGS. 25-32. This embodiment operates and functions in a similar manner to the other embodiments of the present invention. This embodiment comprises a main shoe 500 with a back upper 510 and a side upper 520 attached or integral to a sole 505 of the shoe 500, an adjustable upper 525 over the top of the foot, and an attachable toe cover 600. The adjustable upper 525 includes straps 530 and 540.

The back upper 510 and the side upper 520 extend upwardly from the sole 505 to a height approximately equal to or slightly taller than the depth of the foot. The back upper 510 is preferably integral to the side upper 520 to form a single structure that wraps around the rear of the foot and a part of the side of the foot. The side upper 520 has length of approximately 50% to approximately 80% of the foot. The side upper 520 should not be long enough such that it could contact the toes. Preferably, the side upper 520 tapers and terminates near the front portion of the strap 540.

As briefly described before, the adjustable upper 525 includes the straps 530 and 540 of material that are connected to the adjustable upper 525 on the outer sides of the sole 505. In order to secure the adjustable upper 525, the straps 530 and 540 are stretched over the top of the foot and inserted into loops 535 and 545 (which are attached to the inner sides of the sole 505), and then the straps 530 and 540 are stretched and double backed over such that a top side 532 of the strap 530 attaches to the same top side 532. Likewise, a top side 542 of the strap 540 attaches to the same top side 542. The attachment of the top sides 532 and 542 may be by alternating patches of hook an loop fasteners, snaps, hooks, buttons, or any other method of efficiency for attaching layers of material. In other embodiments, the straps 530 and 540 may extend from the outer side of the sole 505.

The straps 530 and 540 of the adjustable upper 525 allow the user to custom tighten the adjustable upper 525 to their individual preference. The strap 530 is preferably on the outside of the side upper 520. The strap 540 likewise is at least partially on the outside of the side upper 520. As such, the tightening of the straps 530 and 540 compresses the side upper 520 to the sides of the foot. This arrangement buffers or disperses the tightening force of the straps 530 and 540 throughout the side upper 520 and provides a comfortable cradling effect for the foot as well as securing the shoe 500 to the foot.

As with other embodiments of the present invention, a plurality of magnets may also be used to engage the toe cover 600 to the shoe 500. The plurality of magnets provides a sufficient holding force to retain the toe cover 600 to the shoe 500. The plurality of magnets may be in the insole in an inconspicuous manner, or the magnets may be placed on the outsole in a conspicuous manner or in any other suitable location. In the embodiment shown in FIGS. 25-32, magnets 590 are in the outer perimeter of the front of the sole 505. Holes may be bored into the sole 505 to receive the magnets 590. An adhesive may be used to affix the magnets into the holes. The holes containing the magnets 590 may then be backfilled with a covering material to provide a clean looking shoe. In other embodiments, the magnets 590 may placed into holes on the bottom of the sole 505. Correspondingly, oppositely charged magnets 672 are placed in walls 605 of the toe cover 600 to interact with the magnets 590. The oppositely charged magnets 672 may be affixed to or integral with the walls 605 of the toe cover 600.

The toe cover 600 includes an opening edge 630, which will rest upon the strap 540. The toe cover 600 is preferably not affixed to the strap 540. The toe cover 600 further includes a bottom edge 620. The bottom edge 620 is pulled toward the outer perimeter of the front of the sole 505.

The loops 535 and 545 may have a rectangular, looping, or semicircular shape. The loops 535 and 545 may be made of a plastic, metal or other durable material. The loops 535 and 545 are attached to the inner sides of the sole 505. In the embodiment shown in FIGS. 25-32, lengths of material 538 and 548 are used to position the loops 535 and 545.

The sole 505 is preferably made from a dense, comfortable material. The sole 505 may be made from an EVA foam or a polyethylene material. The sole 505 may have a thickness of approximately ¼ inch to approximately 2 inches. Preferably, the sole has a thickness of approximately ¾ inches. In other embodiments, the sole 505 may have a different thickness.

The embodiment of FIGS. 25-32 enables the individual to determine how tight or loose the adjustable upper 525 will fit over his/her uniquely shaped foot. Each individual with have a different instep, width, arch, etc. Additionally, this embodiment will enable the individual to pull his/her foot directly out of the shoe 500 (after the adjustable upper 525 is detached), which provides further precaution for not damaging newly painted toenails. Thus, the shoe 500 provides footwear that protects the newly painted toenails and allows for the footwear to be removed without damaging the newly painted toenails.

The strap 540 traversing over the toes covers the point of inflection of the toes and assists in holding the toes closer to the sole 505 of the shoe 500. Furthermore, the strap 540 is wider than the strap 530. The strap 540 may have a width of approximately 1.5 to approximately 3.5 inches. The strap 530 may have a width of approximately 0.25 inches to approximately 1.5 inches. Preferably, the strap 540 has a width of approximately 2.5 inches, while the strap 530 has a width of approximately 0.5 inches.

After the adjustable upper 525 is adjusted to the user's preference, the user may put the toe cover 600 on to the shoe 500 in a similar way as the other embodiments. The shoe 500 provides a comfortable shoe which may be worn with or without the toe cover.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

What is claimed is:

1. Footwear, comprising:

a main body for receiving a foot;

a toe cover that is repeatedly completely detachable and attachable to the main body or a sole of the footwear;

a rear portion of the footwear that wraps around a rear of the foot to stabilize the foot;

a side upper attached or integral to the main body;

an upper surface forming an opening through which the toes are extended, wherein the upper surface is adjustable;

the upper surface on the outside of the side upper;

the upper surface covering a portion of the foot, and the upper surface reducing or inhibiting the upward movement of the toes; and the toe cover resting on the upper surface.

2. The footwear according to claim 1, wherein the upper surface and the rear portion are connected or integral via the side upper, and the upper surface, the side upper, and the rear portion stabilize the foot.

3. The footwear according to claim 1, wherein a bottom edge of the toe cover detachably connects to the main body or the sole of the footwear.

4. The footwear according to claim 1, wherein the toe cover is generally made of a material more rigid than the main body.

5. The footwear according to claim 1, wherein the toe cover includes an arcuate shaped opening edge, and a top section of the opening edge is not fixed or connected to the upper surface.

6. The footwear according to claim 1, wherein the toe cover includes an arcuate shaped opening edge, and a top section of the opening edge is not fixed or connected to the upper surface, and the upper surface has an arcuate shaped edge to complement the arcuate shaped opening edge.

7. The footwear according to claim 1, wherein the toe cover includes an opening edge, and a top section of the opening edge rests on the upper surface just above a point of inflection for toes.

8. The footwear according to claim 1, wherein the upper surface is not removable from the footwear.

9. The footwear according to claim 1, wherein the upper surface reduces the range of flexion of the toes.

10. The footwear according to claim 1, wherein the toe cover includes a concave surface, and a front portion of the toe cover is higher than a rear portion of the toe cover.

11. The footwear according to claim 1, wherein the toe cover allows the toes to flex without the toes contacting the toe cover.

12. The footwear according to claim 1, wherein the toe cover is repeatedly detachable and attachable to a perimeter of the sole.

13. The footwear according to claim 1, wherein a top section of the toe cover is not attached to the upper surface of the footwear.

14. The footwear according to claim 1, wherein the footwear and its upper surface bend and flex while the toe cover remains rigid.

15. The footwear according to claim 1, wherein the upper surface covers a point where toes of a wearer protrude from the wearer's foot.

16. The footwear according to claim 1, further comprising a toe retainer.

17. The footwear according to claim 1, wherein a strap connects to the upper surface and wraps around the foot.

18. The footwear according to claim 1, wherein the toe cover defines a cavity to contain the toes of a wearer, and the main body comprise magnets.

19. The footwear according to claim 1, comprising removable toe loops.

20. The footwear according to claim 1, comprising a narrowing member affixed or integral to the toe cover or the upper surface.

21. The footwear according to claim 1, wherein the toe cover includes a rim and a front portion of the main body includes a groove.

22. The footwear according to claim 1, wherein the upper surface comprises a first strap and a second strap.

23. The footwear according to claim 22, wherein the first strap is wider than the second strap.

24. The footwear according to claim 22, wherein the toe cover rests on the first strap.

25. The footwear according to claim 1, wherein the toe cover and the main body comprise magnets, wherein the toe cover defines a cavity to contain the toes.

26. The footwear according to claim 25, wherein the main body comprises the magnets placed in holes in a sole.

27. The footwear according to claim 25, wherein the toe cover includes a bottom edge, and the bottom edge is pulled by the magnets toward an outer perimeter of a front of a sole to secure the toe cover to the main body.

28. The footwear according to claim 1, wherein the rear portion is integral to the side upper to form a single structure that wraps around the rear of the foot and a part of the side of the foot.

* * * * *